US011492777B2

(12) United States Patent
Kurokawa et al.

(10) Patent No.: US 11,492,777 B2
(45) Date of Patent: Nov. 8, 2022

(54) SHOVEL AND SYSTEM OF MANAGING SHOVEL

(71) Applicant: SUMITOMO CONSTRUCTION MACHINERY CO., LTD., Tokyo (JP)

(72) Inventors: Tomoki Kurokawa, Chiba (JP); Hiroyuki Tsukamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 345 days.

(21) Appl. No.: 16/898,636

(22) Filed: Jun. 11, 2020

(65) Prior Publication Data

US 2020/0299924 A1 Sep. 24, 2020

Related U.S. Application Data

(63) Continuation of application No. PCT/JP2018/047257, filed on Dec. 21, 2018.

(30) Foreign Application Priority Data

Dec. 21, 2017 (JP) ..... JP2017-245454

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 3/963* (2013.01); *E02F 9/24* (2013.01); *E02F 9/262* (2013.01)

(58) Field of Classification Search
CPC ... E02F 3/32; E02F 3/435; E02F 3/963; E02F 9/2033; E02F 9/24; E02F 9/245; E02F 9/262; E02F 9/265
See application file for complete search history.

(56) References Cited

U.S. PATENT DOCUMENTS 4,600,356 A * 7/1986 Bridges ..... E02F 9/245 172/6
5,169,616 A 12/1992 Ross
(Continued)

FOREIGN PATENT DOCUMENTS

JP H06-065813 3/1994
JP 2003-056010 2/2003
(Continued)

OTHER PUBLICATIONS

International Search Report for PCT/JP2018/047257 dated Mar. 5, 2019.

*Primary Examiner* — Tyler J Lee
(74) *Attorney, Agent, or Firm* — IPUSA, PLLC

(57) ABSTRACT

A shovel includes a lower traveling body, an upper turning body, an attachment including a boom, an arm, and an end attachment, a boom state detector configured to detect the state of the boom, an arm state detector configured to detect the state of the arm, an end attachment state detector configured to detect the state of the end attachment, and a hardware processor. The hardware processor is configured to obtain information on the position of the end attachment based on the respective outputs of the detectors, correlate the information on the position of the end attachment with information on the position of an underground object obtained based on the output of an underground object detector, and calculate the distance between the end attachment and the underground object. The hardware processor is further configured to control the shovel such that the distance is prevented from falling below a predetermined value.

10 Claims, 23 Drawing Sheets

(51) Int. Cl.

| | |
|---|---|
| ***E02F 3/96*** | (2006.01) |
| ***E02F 9/24*** | (2006.01) |
| ***E02F 9/26*** | (2006.01) |

(56) References Cited

U.S. PATENT DOCUMENTS

| | | | | |
|---|---|---|---|---|
| 5,628,130 | A * | 5/1997 | Desrochers | E02F 3/40 37/444 |
| 6,437,726 | B1 * | 8/2002 | Price | E02F 9/245 342/357.62 |
| 8,791,701 | B2 * | 7/2014 | Branson | G01V 3/15 324/67 |
| 9,280,898 | B1 * | 3/2016 | Richmond | B60Q 9/007 |
| 9,292,813 | B2 * | 3/2016 | Tucker | G06Q 10/0631 |
| 9,581,691 | B2 * | 2/2017 | Simicevic | H01Q 19/10 |
| 10,190,288 | B2 * | 1/2019 | Matson | E02F 9/2054 |
| 2002/0063652 | A1 * | 5/2002 | Price | E02F 9/245 342/22 |
| 2008/0133128 | A1 | 6/2008 | Koch | |
| 2010/0052684 | A1 * | 3/2010 | Fling | G01V 3/15 324/326 |
| 2013/0025169 | A1 * | 1/2013 | McCarty | E02F 3/9206 37/195 |
| 2019/0101641 | A1 * | 4/2019 | Hogan | G01S 13/931 |
| 2019/0211532 | A1 * | 7/2019 | Sakamoto | E02F 9/264 |
| 2020/0325656 | A1 * | 10/2020 | Nakano | F17C 13/026 |

FOREIGN PATENT DOCUMENTS

| | | |
|---|---|---|
| JP | 2003-096811 | 4/2003 |
| JP | 2008-058219 | 3/2008 |
| JP | 2008-216143 | 9/2008 |
| JP | 2017-155563 | 9/2017 |

* cited by examiner

SHOVEL AND SYSTEM OF MANAGING SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2018/047257, filed on Dec. 21, 2018 and designating the U.S., which claims priority to Japanese patent application No. 2017-245454, filed on Dec. 21, 2017. The entire contents of the foregoing applications are incorporated herein by reference.

BACKGROUND

Technical Field

The present disclosure relates to shovels and systems of managing a shovel.

Description of Related Art

A system that assists in operating an excavator while schematically displaying invisible buried objects in the ground, such as water pipes, has been known.

This system schematically displays water pipes in the ground, referring to a construction drawing (construction information) including information on the positions of the water pipes as buried objects, created when the water pipes were buried.

SUMMARY

According to an aspect of the present invention, a shovel includes a lower traveling body, an upper turning body turnably attached to the lower traveling body, an attachment including a boom, an am, and an end attachment and attached to the upper turning body, a boom state detector configured to detect the state of the boom, an arm state detector configured to detect the state of the arm, an end attachment state detector configured to detect the state of the end attachment, and a hardware processor. The hardware processor is configured to obtain information on the position of the end attachment based on the respective outputs of the boom state detector, the arm state detector, and the end attachment state detector, correlate the information on the position of the end attachment with information on the position of an underground object obtained based on the output of an underground object detector, and calculate the distance between the end attachment and the underground object. The hardware processor is further configured to control the shovel such that the distance is prevented from falling below a predetermined value.

DETAILED DESCRIPTION

Figure 1:
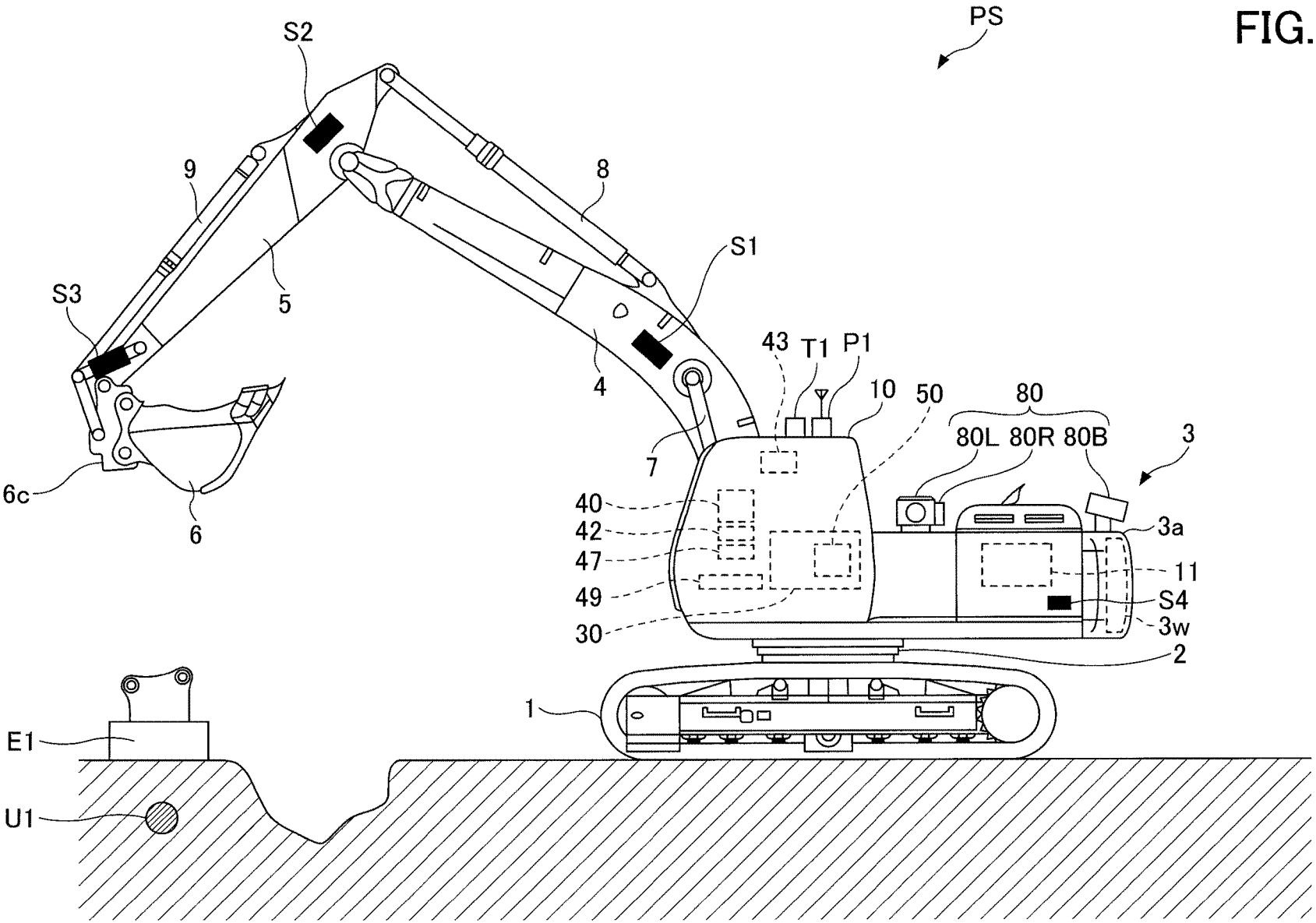
FIG. 1 is a side view of a shovel according to an embodiment of the present invention.

Buried objects, however, may not be buried in line with information stored in construction information. Therefore, buried objects may be accidentally damaged during excavation work.

Therefore, it is desired to provide a shovel that can more reliably prevent damage to underground objects during excavation work.

According to an aspect of the present invention, a shovel that can more reliably prevent damage to underground objects during excavation work is provided.

A shovel according to an embodiment of the present invention is described below with reference to the drawings. In the drawings, identical components are referred to using the same reference numeral, and duplicate description thereof may be omitted.

FIG. 1 is a side view of a shovel PS according to the embodiment of the present invention. An upper turning body 3 is turnably mounted on a lower traveling body 1 of the shovel PS via a turning mechanism 2. The lower traveling body 1 is driven by traveling hydraulic motors, and the upper turning body 3 is driven by a turning hydraulic motor. A boom 4 is attached to the upper turning body 3. An arm 5 is attached to the distal end of the boom 4. A bucket 6 serving as an end attachment (the working part of an attachment) is attached to the distal end of the arm 5 via a quick coupler 6*c*. The boom 4, the arm 5, and the bucket 6 constitute an excavation attachment that is an example of the attachment. The boom 4 is driven by a boom cylinder 7, the arm 5 is driven by an arm cylinder 8, and the bucket 6 is driven by a bucket cylinder 9. In the following, the traveling hydraulic motors, the turning hydraulic motor, the boom cylinder 7, the arm cylinder 8, and the bucket cylinder 9 are collectively referred to as "hydraulic actuators."

Figure 2:
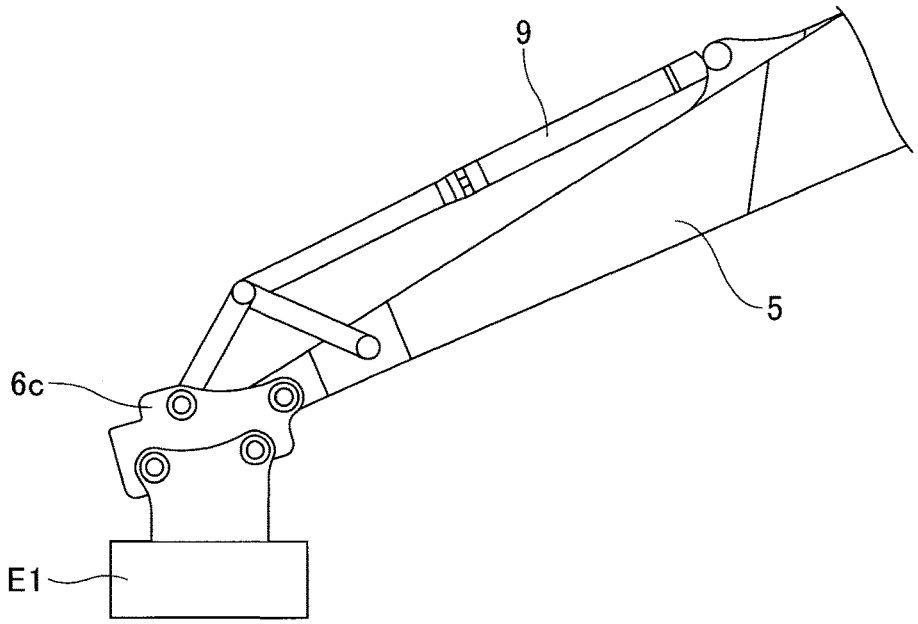
FIG. 2 is a side view of an attachment to which an underground object detector is attached.

The quick coupler 6*c* is a mechanism that enables replacement of the end attachment only by operating the attachment without using tools or the like. According to this embodiment, replaceable end attachments include the bucket 6 and an underground object detector E1. FIG. 1 illustrates the bucket 6 attached to the distal end of the arm 5 via the quick coupler 6*c*, and the underground object detector E1 removed from the quick coupler 6*c*. FIG. 2 illustrates the underground object detector E1 attached to the distal end of the arm 5 via the quick coupler 6*c*.

The underground object detector E1 is a device for detecting underground objects, and is, for example, a ground penetrating radar. According to this embodiment, the underground object detector E1 is attached to the distal end of the arm 5 via the quick coupler 6*c* as illustrated in FIG. 2.

The underground object detector E1 serving as a ground penetrating radar emits electromagnetic waves toward the ground and visualizes subsurface structure using reflected waves from within the ground. Specifically, the underground object detector E1 is moved along the ground. The underground object detector E1 may be moved along the ground either by an operator of the shovel PS manually operating hydraulic actuators or by automatically moving hydraulic actuators. The ground with which the underground object detector E1 is opposed may be either a sloping surface or a vertical surface. For example, the underground object detector E1 may be moved along a vertical surface with the radiating surface of the underground object detector E1 facing the vertical surface.

The underground object detector E1 repeatedly obtains a distance between the underground object detector E1 and an underground object U1 by repeatedly emitting electromagnetic waves and repeatedly receiving electromagnetic waves reflected from the underground object U1 during its movement. For example, the underground object detector E1 derives the position and the size of the underground object U1 based on multiple combinations of the position of the underground object detector E1 and the distance between the underground object detector E1 and the underground object U1 when transmitting and emitting electromagnetic waves.

Figure 3:
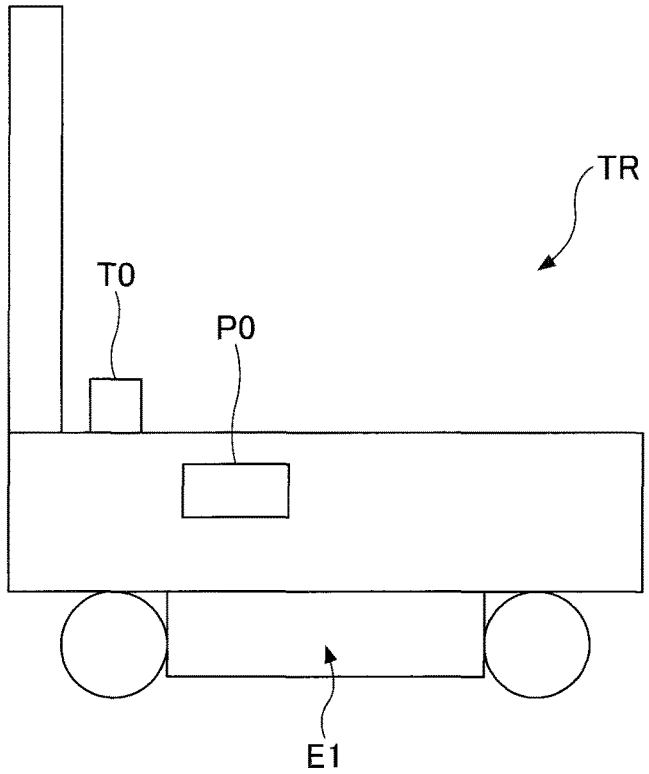
FIG. 3 is a side view of the underground object detector mounted on a hand cart.

The underground object detector E1 may be mounted on a hand cart TR as illustrated in FIG. 3. In this case, a positioning device P0 and a communications device T0 may be mounted on the hand cart TR. The positioning device P0 is, for example, a GNSS compass, and detects the position and the attitude of the hand cart TR. The communications device T0 controls communications between the hand cart TR and an apparatus outside the hand cart TR. This configuration enables the hand cart TR to transmit information on the position of the underground object detector E1 and the distance between the underground object detector E1 and the underground object U1 to the outside.

The underground object detector E1 may also be at least one of a monocular camera, a stereo camera, a distance image sensor, an infrared sensor, an ultrasonic sensor, a metal detector, and a LIDAR that are attachable to the upper turning body 3 because this makes it possible to detect an underground object that is partially exposed at the ground during excavation work. In this case, the underground object detector E1 may be placed on an inside or outside upper part of a cabin 10 such that an area in front of the shovel PS can be included in the detection range.

According to this embodiment, a boom angle sensor S1 serving as a boom state detector is attached to the boom 4, an arm angle sensor S2 serving as an arm state detector is attached to the arm 5, and a bucket angle sensor S3 serving as a bucket state detector is attached to the bucket 6. The boom angle sensor S1, the arm angle sensor S2, and the bucket angle sensor S3 are also referred to as "posture sensors."

The boom angle sensor S1 is configured to detect the rotation angle of the boom 4 relative to the upper turning body 3. The arm angle sensor S2 is configured to detect the rotation angle of the arm 5 relative to the boom 4. The bucket angle sensor S3 is configured to detect the rotation angle of the bucket 6 relative to the arm 5. The boom angle sensor S1, the arm angle sensor S2, and the bucket angle sensor S3 are constituted of, for example, a combination of an acceleration sensor and a gyroscope.

The boom state detector, the arm state detector, and the bucket state detector may alternatively be constituted of, for example, a potentiometer using a variable resistor, a stroke sensor that detects the stroke amount of a corresponding hydraulic cylinder, a rotary encoder that detects a rotation angle about a link shaft, or the like.

An engine 11, a counterweight 3*w*, a body tilt sensor S4, etc., are mounted on the upper turning body 3. The engine 11, the counterweight 3*w*, the body tilt sensor S4, etc., are covered with a cover 3*a*. The body tilt sensor S4 is an acceleration sensor that detects the tilt angle of the upper turning body 3 relative to a horizontal plane. The body tilt sensor S4 may be attached to the exterior of the cover 3*a*.

An image capturing device 80 is provided on the cover 3*a* of the upper turning body 3. The image capturing device 80 includes a left camera 80L that captures an image of a space to the left of the shovel PS, a right camera 80R that captures an image of a space to the right of the shovel PS, and a back camera 80B that captures an image of a space behind the shovel PS. The left camera 80L, the right camera 80R, and the back camera 80B are, for example, digital cameras including an imaging device such as a CCD, a CMOS, or the like, and transmit captured images to a display device 40 provided in the cabin 10.

The cabin 10 serving as a cab is provided on the upper turning body 3. A positioning device P1 and a communications device T1 are provided on the cabin 10. The positioning device P1 is, for example, a GNSS compass, and detects the position of the shovel PS to provide a controller 30 with data on the position. The communications device T1 controls communications between the shovel PS and an apparatus outside the shovel PS. Furthermore, the controller 30, the display device 40, an input device 42, an audio output device 43, a storage device 47, and a gate lock lever 49 are provided in the cabin 10.

The controller 30 operates as a control device to control the driving of the shovel PS. The controller 30 is constituted of a computer including a CPU and an internal memory. Various functions of the controller 30 are implemented by, for example, the CPU executing programs stored in the internal memory. The various functions include, for example, a machine guidance function to give an operator guidance (directions) on manually operating the shovel PS. A machine guidance device 50 included in the controller 30 executes the machine guidance function.

The display device 40 is a device that displays various kinds of information. The display device 40 is, for example, an in-vehicle liquid crystal display connected to the controller 30. According to this embodiment, the display device 40 displays an image including various kinds of work information in response to a command from the controller 30.

The input device 42 is a device for the operator of the shovel PS inputting various kinds of information to the controller 30. The input device 42 is constituted of, for example, at least one of a switch panel, a touchscreen, etc.

The audio output device 43 is a device to output various kinds of audio. The audio output device 43 may be, for example, an in-vehicle loudspeaker connected to the controller 30 or an alarm such as a buzzer. According to this embodiment, the audio output device 43 outputs various kinds of audio information in response to an audio output command from the controller 30.

The storage device 47 is a device for storing various kinds of information. The storage device 47 is, for example, a non-volatile storage medium such as a semiconductor memory. The storage device 47 may store information output by various apparatuses while the shovel PS is in operation and may store information obtained through various apparatuses before the shovel PS starts to operate.

The gate lock lever 49 is a mechanism provided between the door and the operator seat of the cabin 10 to prevent the shovel PS from being accidentally operated. The gate lock lever 49 is pulled up to enable an operating apparatus 26. The gate lock lever 49 is pulled down to disable the operating apparatus 26.

Figure 4:
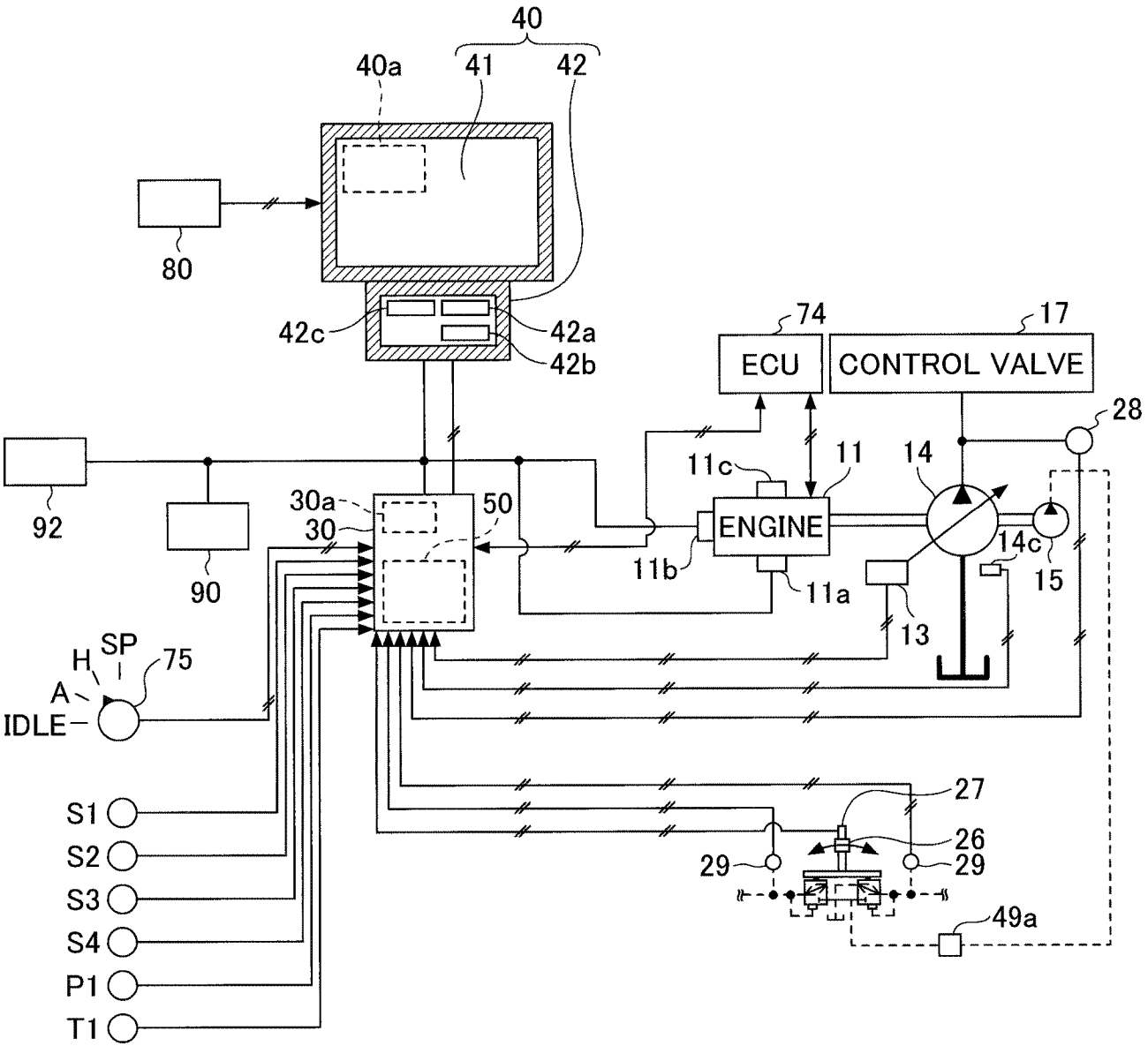
FIG. 4 is a diagram illustrating an example configuration of the basic system of the shovel of FIG. 1.

Next, an example configuration of the basic system of the shovel PS is described with reference to FIG. 4. FIG. 4 is a diagram illustrating an example configuration of the basic system of the shovel PS.

The display device 40 is provided in the cabin 10 to display work information, etc. For example, the display device 40 is connected to the controller 30 via a communications network such as a CAN or a LIN.

The display device 40 includes a processing part 40*a* that generates an image to be displayed on an image display part 41. For example, the processing part 40*a* generates an image to be displayed on the image display part 41, based on image data obtained from the image capturing device 80. The image data obtained from the image capturing device 80 include image data obtained from each of the left camera 80L, the right camera 80R, and the back camera 80B.

The processing part 40*a* may convert various data input to the display device 40 from the controller 30 into image data. Examples of data input to the display device 40 from the controller 30 include data indicating the temperature of engine coolant water, data indicating the temperature of hydraulic oil, data indicating the remaining amount of an aqueous urea solution, data indicating the remaining amount of fuel, etc. The processing part 40*a* generates an image to be displayed on the image display part 41 based on the image data obtained by the conversion, the same as in the case of the image data obtained from the image capturing device 80.

The processing part 40*a* causes images generated based on various kinds of image data to be displayed on the image display part 41. The processing part 40*a* may be provided in, for example, the controller 30 instead of the display device 40. In this case, the image capturing device 80 is connected to the controller 30.

The display device 40 includes a switch panel serving as the input device 42. The switch panel is a panel including various hardware switches. According to this example, the switch panel includes a light switch 42*a*, a windshield wiper switch 42*b*, and a windshield washer switch 42*c*.

The light switch 42*a* is a switch for turning on and off lights attached to the exterior of the cabin 10. The windshield wiper switch 42*b* is a switch for moving and stopping a windshield wiper. The windshield washer switch 42*c* is a switch for spraying windshield washer fluid.

The display device 40 is supplied with electric power from a rechargeable battery 90 to operate. The rechargeable battery 90 is charged with electric power generated in an alternator 11*a* of the engine 11. The electric power of the rechargeable battery 90 is also supplied to electrical equipment 92, etc., of the shovel PS besides the controller 30 and the display device 40. A starter 11*b* of the engine 11 is driven with electric power from the rechargeable battery 90 to start the engine 11.

The engine 11 is connected to a main pump 14 and a pilot pump 15, and is controlled by an engine control unit (ECU) 74. The ECU 74 transmits various data indicating the condition of the engine 11 to the controller 30. Examples of various data include data indicating coolant water temperature detected with a water temperature sensor 11*c*. The controller 30 stores various data in an internal memory 30*a* and transmits the data to the display device 40 on an as-needed basis.

The main pump 14 is a hydraulic pump for supplying hydraulic oil to a control valve 17 via a hydraulic oil line. The main pump 14 is, for example, a swash-plate variable displacement hydraulic pump.

The pilot pump 15 is a hydraulic pump for supplying hydraulic oil to various hydraulic control apparatuses via a pilot line. The pilot pump 15 is, for example, a fixed displacement hydraulic pump. The pilot pump 15, however, may be omitted. In this case, the function carried by the pilot pump 15 may be implemented by the main pump 14. That is, the main pump 14 may have the function of supplying hydraulic oil to the operating apparatus 26, etc., after reducing the pressure of the hydraulic oil with a throttle or the like, apart from the function of supplying hydraulic oil to the control valve 17.

The control valve 17 is a hydraulic control unit that controls a hydraulic system installed in the shovel PS. For example, the control valve 17 is configured to be able to selectively supply hydraulic oil discharged by the main pump 14 to each hydraulic actuator. According to this embodiment, the control valve 17 includes flow control valves corresponding to the hydraulic actuators.

The operating apparatus 26 is provided in the cabin 10 to be used by the operator to operate the hydraulic actuators. When the operating apparatus 26 is operated, hydraulic oil is supplied from the pilot pump 15 to pilot ports of flow control valves corresponding to hydraulic actuators. A pilot pressure commensurate with the direction of operation and the amount of operation of the operating apparatus 26 is applied to a corresponding pilot port.

An operating pressure sensor 29 detects a pilot pressure generated when the operating apparatus 26 is operated, and transmits data indicating the detected pilot pressure to the controller 30. The operating apparatus 26 is provided with a switch button 27. For example, the operator can transmit a command signal to the controller 30 by operating the switch button 27 with a finger while operating the operating apparatus 26 with a hand.

The controller 30 closes a gate lock valve 49*a* when the gate lock lever 49 is pushed down, and opens the gate lock valve 49*a* when the gate lock lever 49 is pulled up. According to this embodiment, the gate lock valve 49*a* is a solenoid valve provided in an oil conduit between the control valve 17 and the operating apparatus 26. The gate lock valve 49*a* opens or closes in response to a command from the controller 30. Alternatively, the gate lock valve 49*a* may be mechanically connected to the gate lock lever 49 to open or close in response to the operation of the gate lock lever 49.

The gate lock valve 49*a* is closed to close the oil conduit between the control valve 17 and the operating apparatus 26 to disable the operating apparatus 26. The gate lock valve 49*a* is open to open the oil conduit between the control valve 17 and the operating apparatus 26 to enable the operating apparatus 26.

With the gate lock valve 49*a* being open to have the operating apparatus 26 enabled, the controller 30 detects the direction of operation and the amount of operation of the operating apparatus 26 from a pilot pressure detected by the operating pressure sensor 29.

Furthermore, the controller 30 obtains data indicating a swash plate angle from a regulator 13 of the main pump 14, which is a variable displacement hydraulic pump. The controller 30 obtains data indicating the discharge pressure of the main pump 14 from a discharge pressure sensor 28. Furthermore, the controller 30 obtains, from an oil temperature sensor 14*c* provided in an oil conduit between the main pump 14 and a tank storing hydraulic oil to be drawn in by the main pump 14, data representing the temperature of hydraulic oil flowing through the oil conduit. The controller 30 stores these data in the internal memory 30*a*.

An engine rotational speed adjustment dial 75 is provided in the cabin 10 of the shovel PS. The engine rotational speed adjustment dial 75 is a dial for adjusting the engine rotational speed. For example, the operator of the shovel PS can switch the engine rotational speed in a stepwise manner by operating the engine rotational speed adjustment dial 75. According to this embodiment, the engine rotational speed adjustment dial 75 is provided to enable the operator to switch the engine rotational speed among the four levels of SP mode, H mode, A mode, and IDLE mode. The engine rotational speed adjustment dial 75 transmits data indicating the setting of the engine rotational speed to the controller 30. FIG. 4 illustrates a state where the H mode is selected by the engine rotational speed adjustment dial 75.

The SP mode is a rotational speed mode selected when it is desired to prioritize workload, and uses the highest engine rotational speed. The H mode is a rotational speed mode selected when it is desired to satisfy both workload and fuel efficiency, and uses the second highest engine rotational speed. The A mode is a rotational speed mode selected when it is desired to operate the shovel PS with low noise while prioritizing fuel efficiency, and uses the third highest engine rotational speed. The IDLE mode is a rotational speed mode selected when it is desired to idle the engine, and uses the lowest engine rotational speed. The engine 11 is controlled to operate constantly at an engine rotational speed corresponding to a rotational speed mode set by the engine rotational speed adjustment dial 75.

In addition to controlling the operation of the entirety of the shovel PS, the controller 30 controls whether to provide guidance by the machine guidance device 50. Specifically, in response to determining that the shovel PS is not working, the controller 30 transmits a guidance stop command to the machine guidance device 50 to stop guidance by the machine guidance device 50.

The controller 30 may output a guidance stop command to the machine guidance device 50 when outputting an automatic idling stop command to the ECU 74. Alternatively, the controller 30 may output a guidance stop command to the machine guidance device 50 in response to determining that the gate lock lever 49 is pushed down.

The machine guidance device 50 is so configured as to be able to execute the machine guidance function. According to this embodiment, for example, the machine guidance device 50 notifies the operator of work information such as the distance between a target work surface that is the surface of a target ground form set by the operator and the working part of the attachment. Data on the target work surface are prestored in the storage device 47, for example. Furthermore, the data on the target work surface are expressed in a reference coordinate system, for example. The reference coordinate system is, for example, the world geodetic system. The world geodetic system is a three-dimensional Cartesian coordinate system with the origin at the center of mass of the Earth, the X-axis oriented toward the point of intersection of the prime meridian and the equator, the Y-axis oriented toward 90 degrees east longitude, and the Z-axis oriented toward the Arctic pole. The operator may set any point at a work site as a reference point and set the target work surface based on a relative positional relationship between the target work surface and the reference point. The working part of the attachment is, for example, the teeth tips of the bucket 6, the back surface of the bucket 6, the center of the radiating surface of the underground object detector E1, or the like. The machine guidance device 50 provides guidance on operating the shovel PS by notifying the operator of work information via at least one of the display device 40, the audio output device 43, etc.

The machine guidance device 50 may execute a machine control function to automatically assist the operator in manually operating the shovel PS. For example, when the operator is manually performing operation for excavation, the machine guidance device 50 may cause at least one of the boom 4, the arm 5, and the bucket 6 to automatically operate such that the leading edge position of the bucket 6 coincides with the target work surface.

While incorporated into the controller 30 according to this embodiment, the machine guidance device 50 may be a control device provided separately from the controller 30. In this case, for example, like the controller 30, the machine guidance device 50 is constituted of a computer including a CPU and an internal memory, and the CPU executes programs stored in the internal memory to implement various functions of the machine guidance device 50. The machine guidance device 50 and the controller 30 are connected by a communications network such as a CAN to be able to communicate with each other.

Figure 5:
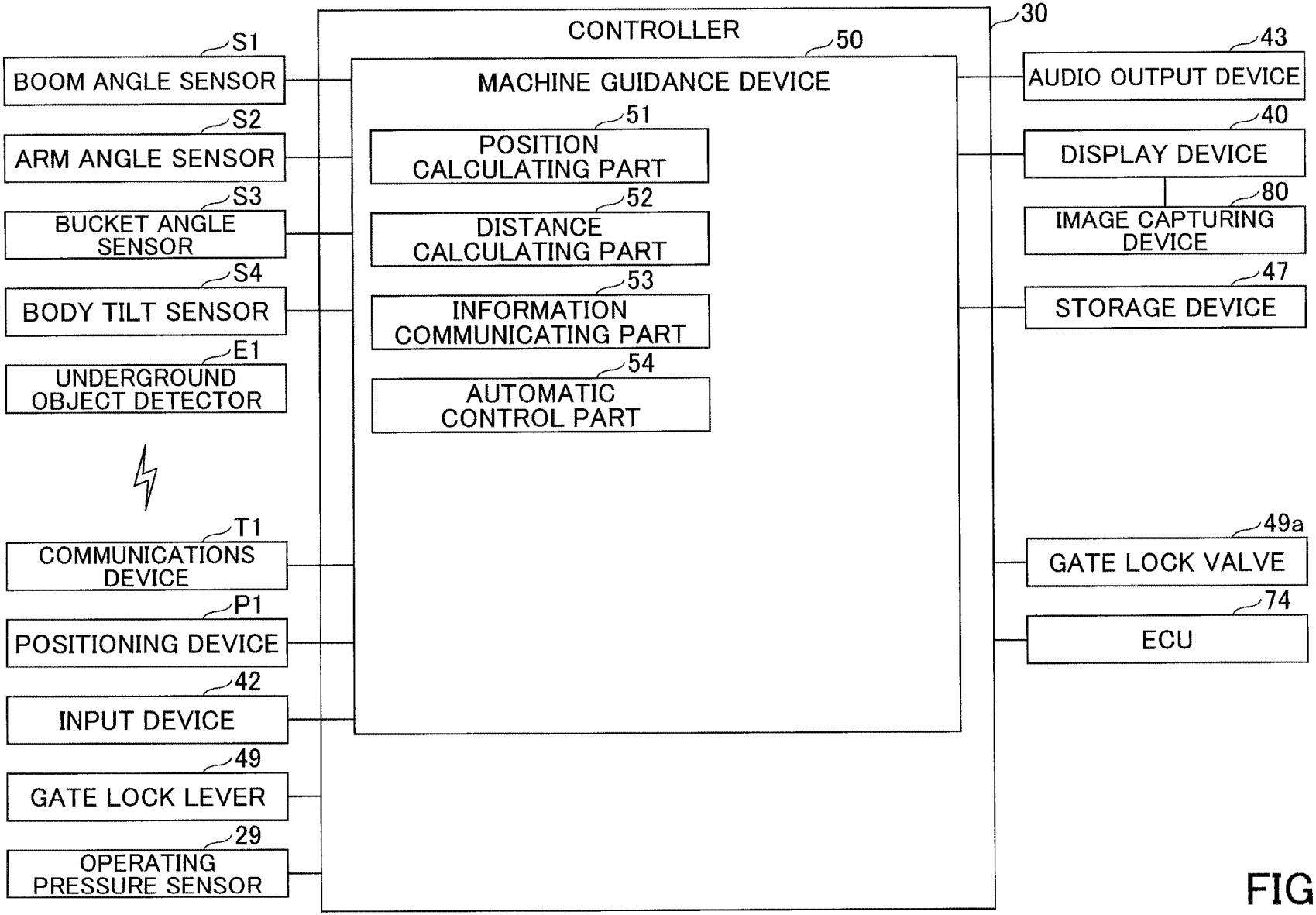
FIG. 5 is a diagram illustrating an example configuration of a machine guidance device.

Next, various functions of the machine guidance device 50 of the shovel PS are described with reference to FIG. 5. FIG. 5 is a block diagram illustrating an example configuration of the machine guidance device 50 included in the controller 30.

The machine guidance device 50 obtains information from the boom angle sensor S1, the arm angle sensor S2, the bucket angle sensor S3, the body tilt sensor S4, the underground object detector S1, the positioning device P1, the communications device T1, the input device 42, etc.

According to this embodiment, the underground object detector E1 has a radio communication function and wirelessly transmits information on underground objects (hereinafter "underground object information") to the communications device T1 of the shovel PS. That is, the controller 30 obtains the underground object information via the communications device T1. Alternatively, the underground object detector E1 may be wired to the controller 30.

The controller 30 stores the underground object information obtained beforehand in the storage device 47 so that the underground object information can be used for the machine guidance function or the machine control function that is executed when excavation work is performed. For example, in the case of having executed the machine guidance function using the underground object information, the controller 30 can output an alarm when the teeth tips of the bucket 6 approach an underground object. In the case of having executed the machine control function using the underground object information, the controller 30 can automatically assist in moving the attachment such that the teeth tips of the bucket 6 do not contact an underground object.

In the case of executing the machine guidance function or the machine control function using information on buried objects (hereinafter "buried object data") prestored in the storage device 47, the controller 30 may correct the buried object data based on the underground object information obtained beforehand. The buried object data are data including information on the positions of objects as buried objects, created when objects such as power lines, telephone lines, gas pipes, water pipes, or the like are buried.

The machine guidance device 50, for example, calculates a distance between the bucket 6 and the target work surface or a buried object based on obtained information. The machine guidance device 50 notifies the shovel operator of the size of the distance between the bucket 6 and the target work surface or a buried object using audio or image display.

Specifically, the machine guidance device 50 includes a position calculating part 51, a distance calculating part 52, an information communicating part 53, and an automatic control part 54.

The position calculating part 51 is configured to calculate the position of an object whose location is to be determined. According to this embodiment, the position calculating part 51 calculates the coordinate point of the working part of the attachment in the reference coordinate system. Specifically, the position calculating part 51 calculates the coordinate point of the teeth tips of the bucket 6 from the respective rotation angles of the boom 4, the arm 5, and the bucket 6.

Furthermore, when the underground object detector E1 is attached to the arm 5 via the quick coupler 6*c*, the position calculating part 51 calculates the coordinate point of the underground object detector E1 the same as in the case of calculating the coordinate point of the teeth tips of the bucket 6. The coordinate point of the underground object detector E1 is, for example, the coordinate point of the central point of the radiating surface. According to this configuration, the position calculating part 51 can calculate the position and the size of an underground object based on the temporal transition of the coordinate point of the underground object detector E1 and the temporal transition of the distance between the underground object detector E1 and the underground object. The position and the size of an underground object are represented by, for example, a group of coordinate points constituting the underground object.

In the case where the underground object detector E1 is mounted on the hand cart TR as illustrated in FIG. 3, the position calculating part 51 may calculate the coordinate point of the underground object detector E1 using a position detector (not depicted) attached to the upper turning body 3. The position detector is, for example, at least one of a stereo camera, a distance image sensor, a laser radar, an ultrasonic sensor, a LIDAR, etc.

Alternatively, the position calculating part 51 may calculate the coordinate point of the underground object detector E1 based on a detection value of the positioning device P0 mounted on the hand cart TR. The detection value of the positioning device P0, along with a detection value of the underground object detector E1, is supplied to the controller 30 via the communications device T0 mounted on the hand cart TR and the communications device T1 mounted on the shovel PS.

The distance calculating part 52 is configured to calculate the distance between two objects whose locations are to be determined. According to this embodiment, the distance calculating part 52 calculates the vertical distance between the teeth tips of the bucket 6 and the target work surface. In the case where an underground object exists, the distance calculating part 52 may calculate the shortest distance between the teeth tips of the bucket 6 and the underground object.

The information communicating part 53 is configured to communicate various kinds of information to the shovel operator. According to this embodiment, the information communicating part 53 notifies the operator of the shovel PS of the size of each of the various distances calculated by the distance calculating part 52. Specifically, the information communicating part 53 notifies the shovel operator of the size of the vertical distance between the teeth tips of the bucket 6 and the target work surface, the size of the shortest distance between the teeth tips of the bucket 6 and an underground object, etc., using at least one of visual information and aural information.

For example, the information communicating part 53 may notify the operator of the size of the vertical distance between the teeth tips of the bucket 6 and the target work surface, using intermittent sounds through the audio output device 43. In this case, the information communicating part 53 may reduce the interval between intermittent sounds as the vertical distance decreases. Furthermore, when the teeth tips of the bucket 6 are positioned lower than the target work surface, the information communicating part 53 may issue an alarm to the operator via the audio output device 43. The alarm is, for example, a sound significantly louder than the intermittent sounds.

Alternatively, the information communicating part 53 may notify the operator of the size of the shortest distance between the teeth tips of the bucket 6 and an underground object, using other different intermittent sounds than the intermittent sounds for the vertical distance. In this case, the interval between intermittent sounds may be reduced as the shortest distance decreases.

The information communicating part 53 may use a continuous sound and may represent variations in the size of each of the various distances by changing at least one of the pitch, loudness, etc., of the sound.

Furthermore, the information communicating part 53 may display at least one of the size of the vertical distance between the teeth tips of the bucket 6 and the target work surface, the size of the shortest distance between the teeth tips of the bucket 6 and an underground object, etc., on the display device 40 as work information. For example, the display device 40 displays the work information received from the information communicating part 53 on a screen, together with image data received from the image capturing device 80.

The automatic control part 54 is configured to automatically assist the operator in manually operating the shovel PS by automatically moving hydraulic actuators.

For example, the automatic control part 54 automatically extends or retracts at least one of the boom cylinder 7, the arm cylinder 8, and the bucket cylinder 9 such that the position of the teeth tips of the bucket 6 coincides with the target work surface, while the operator is manually performing an arm closing operation. In this case, only by operating an arm operating lever in a closing direction, the operator can close the arm 5 while making the teeth tips of the bucket 6 coincide with the target work surface.

Alternatively, the automatic control part 54 may automatically extend or retract at least one of the boom cylinder 7, the arm cylinder 8, and the bucket cylinder 9 such that the teeth tips of the bucket 6 do not contact a buried object, while the operator is manually performing an arm closing operation. In this case, only by operating an arm operating lever in a closing direction, the operator can close the arm 5 while avoiding contact between the teeth tips of the bucket 6 and the buried object.

According to this embodiment, the automatic control part 54 can automatically move the hydraulic actuators by individually and automatically adjusting pilot pressures acting on flow control valves corresponding to the hydraulic actuators.

Next, an example of an output image displayed during a guidance mode is described with reference to FIG. 6. The guidance mode is an operating mode that is selected when executing the machine guidance function or the machine control function. According to this embodiment, the guidance mode starts when a guidance mode button (not depicted) is depressed.

Figure 6:
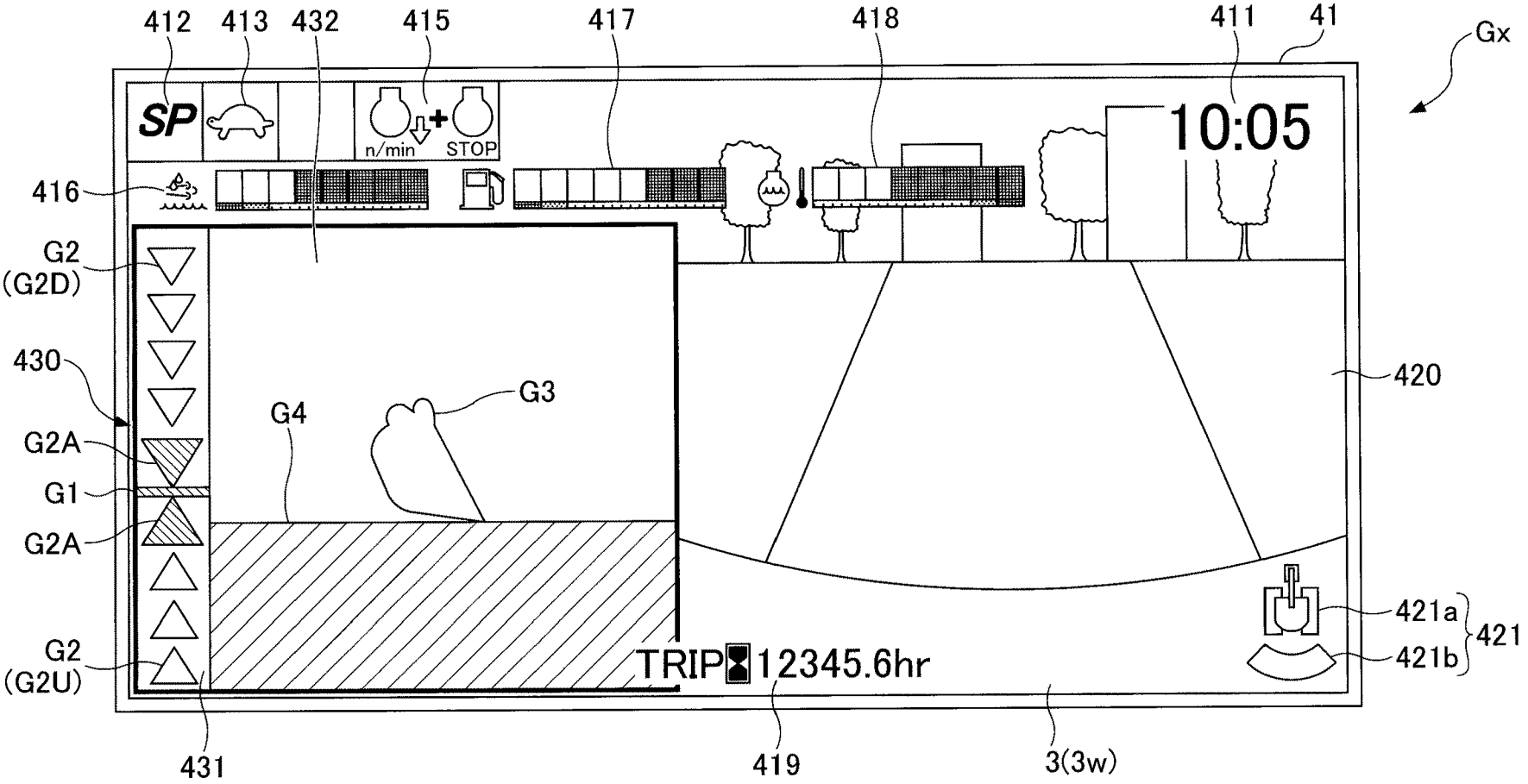
FIG. 6 is a diagram illustrating an example of an output image displayed during a guidance mode.

As illustrated in FIG. 6, an output image Gx displayed on the image display part 41 of the display device 40 includes a time display part 411, a rotational speed mode display part 412, a travel mode display part 413, an engine control status display part 415, a remaining aqueous urea solution amount display part 416, a remaining fuel amount display part 417, a coolant water temperature display part 418, an engine operating time display part 419, a camera image display part 420, and a work guidance display part 430. The rotational speed mode display part 412, the travel mode display part 413, and the engine control status display part 415 are a display part that displays information on the settings of the shovel PS. The remaining aqueous urea solution amount display part 416, the remaining fuel amount display part 417, the coolant water temperature display part 418, and the engine operating time display part 419 are a display part that displays information on the operating condition of the shovel PS. Images displayed in the respective parts are generated by the processing part 40*a* of the display device 40, using various kinds of data transmitted from the controller 30 or the machine guidance device 50 and image data transmitted from the image capturing device 80.

The time display part 411 displays a current time. According to the illustration of FIG. 6, a digital display is employed, and a current time (10:05) is displayed.

The rotational speed mode display part 412 displays a rotational speed mode set by the engine rotational speed adjustment dial 75 as an image as operating information of the shovel PS. The rotational speed mode includes, for example, the above-described four modes of SP mode, H mode, A mode, and IDLE mode. According to the illustration of FIG. 6, a symbol "SP" representing the SP mode is displayed.

The travel mode display part 413 displays a currently set travel mode as operating information of the shovel PS. The travel mode represents the setting of traveling hydraulic motors as variable displacement motors. For example, the travel mode includes a low-speed mode and a high-speed mode. A "turtle"-shaped mark is displayed during the low-speed mode, and a "rabbit"-shaped mark is displayed during the high-speed mode. According to the illustration of FIG. 6, the "turtle"-shaped mark is displayed to make it possible for the operator to be aware that the low-speed mode is set.

The engine control status display part 415 displays the control status of the engine 11 as operating information of the shovel PS. According to the illustration of FIG. 6, "automatic deceleration and automatic stop mode" is selected as the control status of the engine 11. The "automatic deceleration and automatic stop mode" means a control status to automatically reduce the engine rotational speed and further to automatically stop the engine 11 in accordance with the duration of a non-operating state. Other control statuses of the engine 11 include "automatic deceleration mode," "automatic stop mode," and "manual deceleration mode."

The remaining aqueous urea solution amount display part 416 displays the status of the remaining amount of an aqueous urea solution stored in an aqueous urea solution tank as operating information of the shovel PS. According to the illustration of FIG. 6, a bar gauge representing the current status of the remaining amount of an aqueous urea solution is displayed. The remaining amount of an aqueous urea solution is displayed based on the output data of a remaining aqueous urea solution amount sensor provided in the aqueous urea solution tank.

The remaining fuel amount display part 417 displays the status of the remaining amount of fuel stored in a fuel tank as operating information of the shovel PS. According to the illustration of FIG. 6, a bar gauge representing the current status of the remaining amount of fuel is displayed. The remaining amount of fuel is displayed based on the output data of a remaining fuel amount sensor provided in the fuel tank.

The coolant water temperature display part 418 displays the temperature condition of engine coolant water as operating information of the shovel PS. According to the illustration of FIG. 6, a bar gauge representing the temperature condition of engine coolant water is displayed. The temperature of engine coolant water is displayed based on the output data of the water temperature sensor 11*c* provided on the engine 11.

The engine operating time display part 419 displays the cumulative operating time of the engine 11 as operating information of the shovel PS. According to the illustration of FIG. 6, a section operating time since the reset of counting by the operator is displayed together with a unit "hr (hour)." A lifelong operating time for the entire period after the manufacture of the shovel may be displayed in the engine operating time display part 419.

The camera image display part 420 displays an image captured by the image capturing device 80. According to the illustration of FIG. 6, an image captured by the back camera 80B attached to the back end of the upper surface of the upper turning body 3 is displayed in the camera image display part 420. A camera image captured by the left camera 80L attached to the left end of the upper surface of the upper turning body 3 or the right camera 80R attached to the right end of the upper surface of the upper turning body 3 may be displayed in the camera image display part 420. Furthermore, images captured by two or more of the left camera 80L, the right camera 80R, and the back camera 80B may be displayed side by side in the camera image display part 420. A composite image of multiple camera images captured by at least two of the left camera 80L, the right camera 80R, and the back camera 80B may be displayed in the camera image display part 420. The composite image may be, for example, an overhead view image.

Each camera is installed in such a manner as to include part of the upper turning body 3 in its imaging range. Inclusion of an image of part of the upper turning body 3 in a displayed image makes it easier for the operator to understand the distance between an object displayed in the camera image display part 420 and the shovel PS.

In the camera image display part 420, a graphic shape 421 representing the orientation of the image capturing device 80 that has captured a currently displayed camera image is displayed. The graphic shape 421 is composed of a shovel graphic shape 421*a* representing the shape of the shovel PS and a strip-shaped direction indicator graphic shape 421*b* representing the imaging direction of the image capturing device 80 that has captured the currently displayed camera image. The camera image display part 420 including the graphic shape 421 is a display part that displays information on the settings of the shovel PS.

According to the illustration of FIG. 6, the direction indicator graphic shape 421*b* is displayed below the shovel graphic shape 421*a* (on the opposite side from the attachment graphic shape) to indicate that an image of an area behind the shovel PS captured with the back camera 80B is displayed in the camera image display part 420. For example, when an image captured by the right camera 80R is displayed in the camera image display part 420, the direction indicator graphic shape 421*b* is displayed to the right of the shovel graphic shape 421*a*. For example, when an image captured by the left camera 80L is displayed in the camera image display part 420, the direction indicator graphic shape 421*b* is displayed to the left of the shovel graphic shape 421*a*.

For example, the operator can switch an image displayed in the camera image display part 420 to an image captured by another camera or the like by depressing an image change switch (not depicted) provided in the cabin 10.

If the shovel PS is not provided with the image capturing device 80, the camera image display part 420 may be replaced with a different display part that displays different information.

The work guidance display part 430 displays guidance information for various kinds of work. According to the illustration of FIG. 6, the work guidance display part 430 includes a position indicator image 431 and a target work surface display image 432, and displays teeth tips guidance information that is an example of working part guidance information.

The position indicator image 431 represents a change in the size of a relative distance from the working part (leading edge) of the bucket 6 to the target work surface by changing the display position of a graphic shape representing the working part (leading, edge) of the bucket 6 relative to the display position of a graphic shape representing the position of the target work surface. According to the illustration of FIG. 6, the position indicator image 431 is a bar gauge of vertically arranged graphic shapes (segments). The position indicator image 431 includes a target segment G1 and multiple segments G2.

The target segment G1 is a graphic shape representing the position of the target work surface. According to this embodiment, the target segment G1 is a graphic shape (straight line) indicating that the relative distance from the working part (leading edge) of the bucket 6 to the target work surface is within a predetermined range. The predetermined range is a range preset as an appropriate relative distance range. That the relative distance is within the predetermined range means that the working part of the bucket 6 is at an appropriate position.

Each segment G2 is a graphic shape corresponding to a predetermined relative distance. A segment G2 corresponding to a smaller relative distance is placed closer to the target segment G1. A segment G2 corresponding to a greater relative distance is placed farther from the target segment G1. Each segment G2 represents the recommended direction of movement of the bucket 6 as well as the relative distance. The recommended direction of movement of the bucket 6 is a direction to move the working part of the bucket 6 toward the target work surface. According to this embodiment, a segment G2D indicates that the bucket 6 is moved downward to approach the target work surface, and a segment G2U indicates that the bucket 6 is moved upward to approach the target work surface.

The position indicator image 431 displays a segment G2 corresponding to the actual relative distance from the working part (leading edge) of the bucket 6 to the target work surface in a predetermined color different from the color of the other segments G2. FIG. 6 indicates the segment G2 displayed in a color different from the color of the other segments G2 as a segment G2A. The position indicator image 431 indicates the relative distance and the recommended direction of movement by displaying the segment G2A in a predetermined color. As the relative distance from the working part (leading edge) of the bucket 6 to the target work surface becomes greater, a segment G2 more distant from the target segment G1 is displayed in a predetermined color as the segment G2A. As the relative distance from the working part (leading edge) of the bucket 6 to the target work surface becomes smaller, a segment G2 closer to the target segment G1 is displayed in a predetermined color as the segment G2A. Thus, the segment G2A is so displayed as to vertically change the position as the relative distance changes.

When the actual relative distance of the bucket 6 with respect to the target work surface is within the predetermined range, the position indicator image 431 displays the target segment G1 in a predetermined color different from the color of the other segments. That is, the position indicator image 431 indicates that the relative distance is within the predetermined range by displaying the target segment G1 in a predetermined color.

While the segment G2A and the target segment G1 are displayed in a predetermined color, the other segments G2 may be displayed in a relatively inconspicuous color (for example, color equal or similar to a background color) or may not be displayed.

The target work surface display image 432 schematically shows the relationship between the bucket 6 and the target work surface. In the target work surface display image 432, the bucket 6 and the target work surface as viewed from the side are schematically shown by a bucket graphic shape G3 and a target work surface image G4 that serve as a first graphic shape. The bucket graphic shape G3 is a graphic shape that represents the bucket 6, and is shown in the shape of the bucket 6 as viewed from the side. The target work surface image G4 is a graphic shape that represents the ground as the target work surface, and is shown in the shape of the ground as viewed from the side the same as the bucket graphic shape G3. The vertical interval between the bucket graphic shape G3 and the target work surface image G4 is so displayed as to change as the actual distance between the leading edge of the bucket 6 and the target work surface changes. Likewise, the relative inclination angle between the bucket graphic shape G3 (for example, a line segment representing the back surface of the bucket 6) and the target work surface image G4 (for example, a line segment representing the target work surface) is so displayed as to change as the actual relative inclination angle between the bucket 6 (back surface) and the target work surface changes. According to this embodiment, the target work surface display image 432 is configured such that the display height and the display angle of the target work surface image G4 change with the display height and the display angle of the bucket graphic shape G3 being fixed. Alternatively, the target work surface display image 432 may be configured such that the display height and the display angle of the bucket graphic shape G3 change with the display height and the display angle of the target work surface image G4 being fixed, or the target work surface display image 432 may be configured such that the display height and the display angle of each of the bucket graphic shape G3 and the target work surface image G4 change.

According to this configuration, the information communicating part 53 can notify the shovel operator of the size of the vertical distance between the teeth tips of the bucket 6 and the target work surface using at least one of visual information and aural information.

Figure 7:
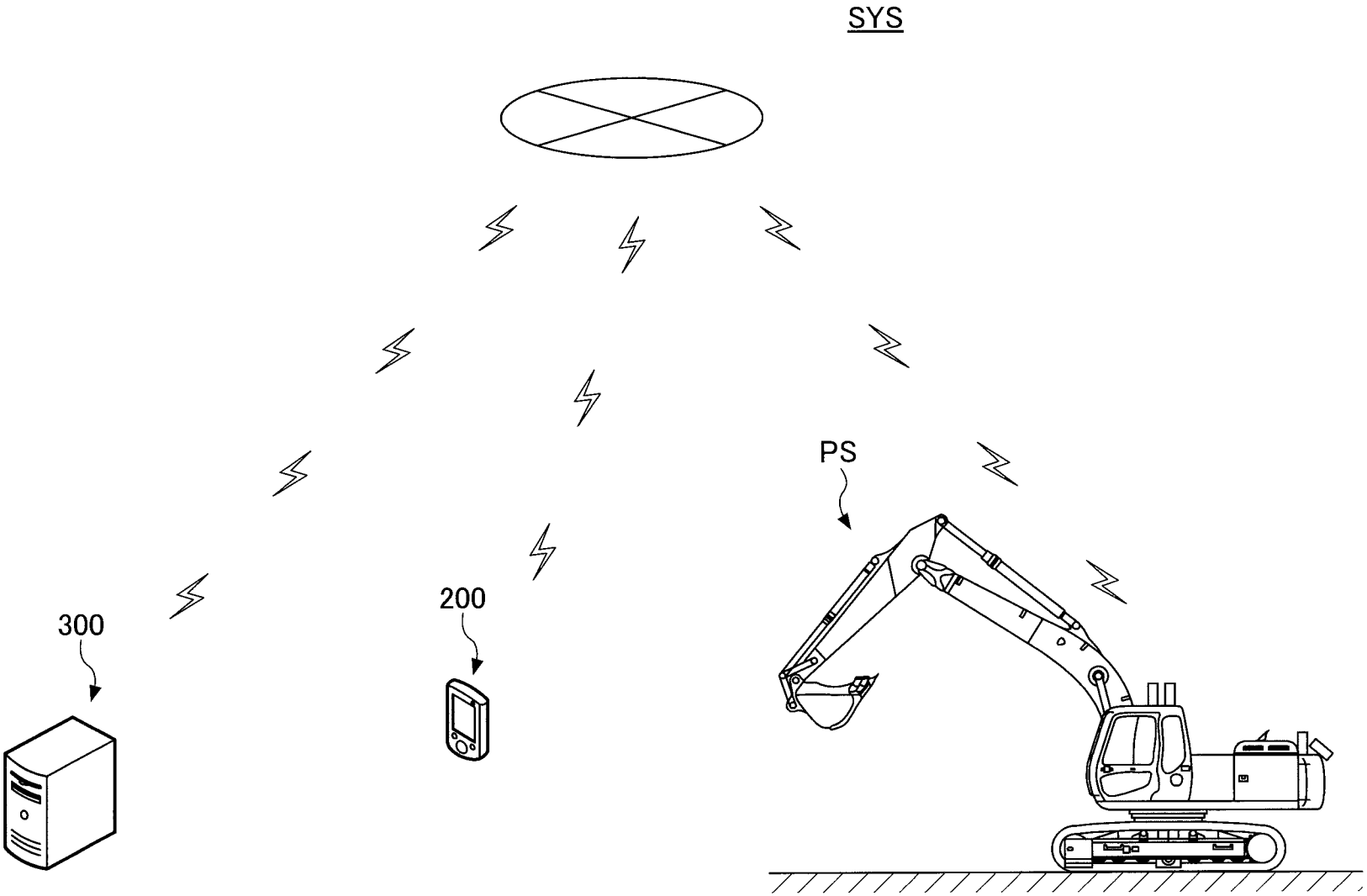
FIG. 7 is a schematic diagram illustrating an example configuration of a management system of the shovel.

According to the above-described embodiment, the machine guidance device 50 obtains the position information of buried objects from construction information including information on the positions of the buried objects. Here, the machine guidance device 50 may reflect the buried object data corrected based on a detection value of the underground object detector E1 in the construction information or may transmit the buried object data corrected based on the detection value of the underground object detector E1 to a management apparatus 300 as illustrated in FIG. 7. In this case, the management apparatus 300 may reflect the buried object data transmitted from the machine guidance device 50 in the construction information, in order that the operator of the shovel PS and other shovel operators, a manager, or the like can share the construction information including the corrected buried object data.

FIG. 7 is a schematic diagram illustrating an example configuration of a shovel management system SYS. The management system SYS is a system that manages the shovel PS. According to this embodiment, the management system SYS is constituted mainly of the shovel PS, an assist device 200, and the management apparatus 300. Each of the shovel PS, the assist device 200, and the management apparatus 300 constituting the management system SYS may be one or more in number. According to this embodiment, the management system SYS includes the single shovel PS, the single assist device 200, and the single management apparatus 300.

The assist device 200 is a portable terminal device, and is, for example, a computer carried by a worker or the like at a work site, such as a notebook PC, a tablet PC, or a smartphone. The assist device 200 may also be a computer carried by the operator of the shovel PS. The computer includes a CPU and an internal memory. Various functions of the computer are implemented by, for example, the CPU executing programs stored in the internal memory.

The management apparatus 300 is a stationary terminal apparatus, and is, for example, a computer installed in a management center or the like outside a work site. The management apparatus 300 may also be a portable computer (for example, a portable terminal device such as a notebook PC, a tablet PC, or a smartphone). The computer includes a CPU and an internal memory. Various functions of the computer are implemented by, for example, the CPU executing programs stored in the internal memory.

According to the management system SYS, in the case of having corrected the buried object data based on a detection value of the underground object detector E1, the shovel PS may transmit the corrected buried object data to the management apparatus 300. The management apparatus 300, which has received the corrected buried object data, may reflect the corrected buried object data in the construction information. Examples of the buried object data include the position, type, size or the like of a buried object.

The shovel PS may correct the buried object data based on not only information on invisible buried objects in the ground, such as a detection value of a metal detector that is an example of the underground object detector E1, but also information on visible buried objects exposed at the ground, such as an image captured by a camera, LIDAR, or the like that is another example of the underground object detector E1 (for example, a camera, LIDAR, or the like attached to the front end of the upper surface of the cabin 10). That is, the buried object data may be corrected based on not only estimated values related to invisible buried objects but also on determined values related to visible buried objects.

The buried object data may be corrected in the assist device 200 or the management apparatus 300. In the case of correcting the buried object data in the management apparatus 300, the shovel PS transmits information necessary for the correction to the management apparatus 300. The same is true for the case of correcting the buried object data in the assist device 200.

Furthermore, the information on visible buried objects exposed at the ground is not limited to information obtained by a camera, a LIDAR, or the like, and may also be information that a worker inputs through the assist device 200 or the like. In this case, the information input through the assist device 200 may be transmitted to the shovel PS or the management apparatus 300 through radio communications. The shovel PS or the management apparatus 300 may correct the buried object data based on the received information.

The shovel PS may be configured to display the size of a difference between the buried object data before correction and the buried object data after the correction. Furthermore, the shovel PS may be configured to display the size of a difference between estimated values related to invisible buried objects and determined values related to visible buried objects. By looking at such display, the operator can estimate the displacements of other nearby buried objects. Furthermore, the operator can predict possible future displacements of buried objects.

The shovel PS may also be configured such that not only the construction information including the buried object data but also information on geological conditions can be shared by the operator of the shovel PS and an operator of another shovel, a manager or the like.

The information on geological conditions is information on at least one of the hardness, density, etc., of earth or the like that is an object of excavation, and is typically derived from the outputs of various sensors installed in the shovel PS. The information on geological conditions, however, may be information that a worker measures with various kinds of apparatus such as a soil hardness tester. In this case, the information measured by the worker may be input to the assist device 200 and transmitted to the shovel PS or the management apparatus 300.

Figure 8A:
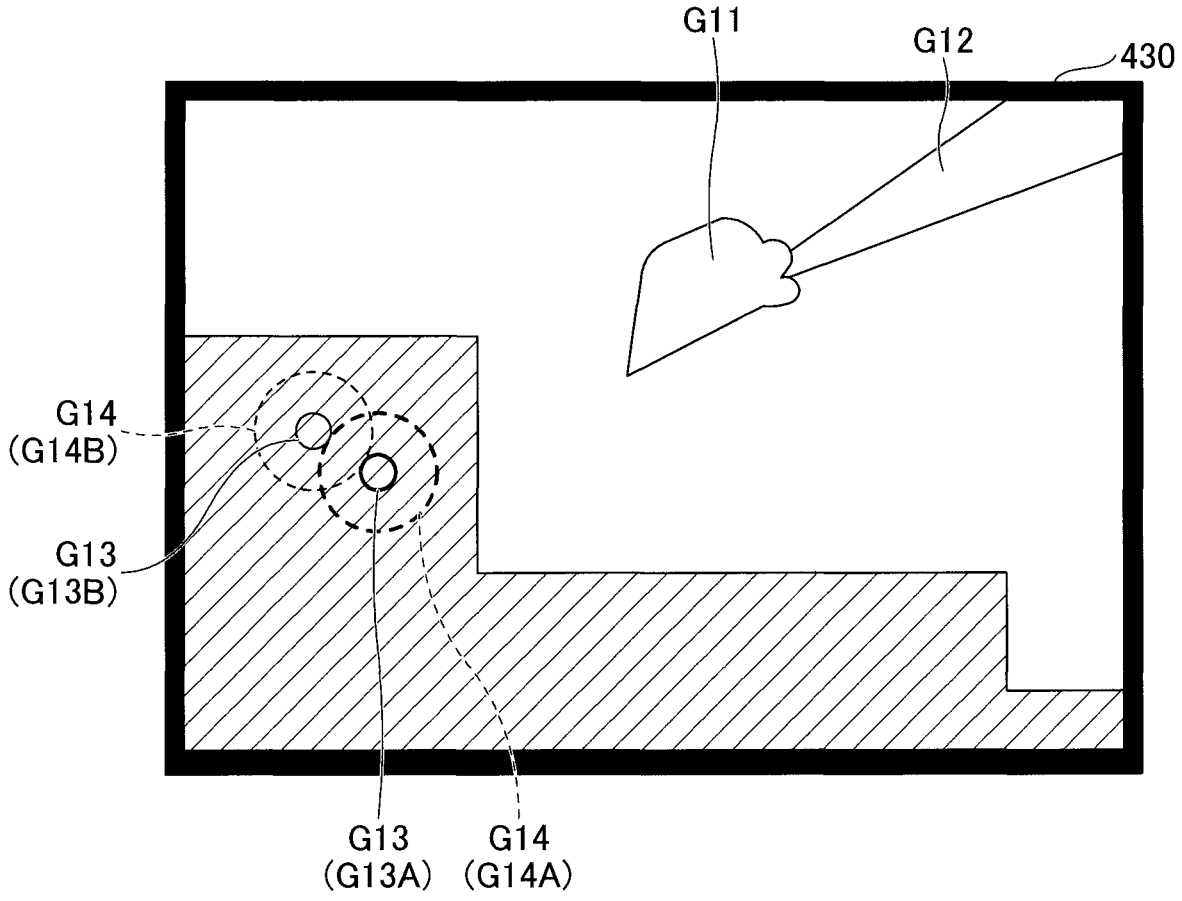
FIG. 8A is a diagram illustrating another example of the output image displayed during the guidance mode.
Figure 8B:
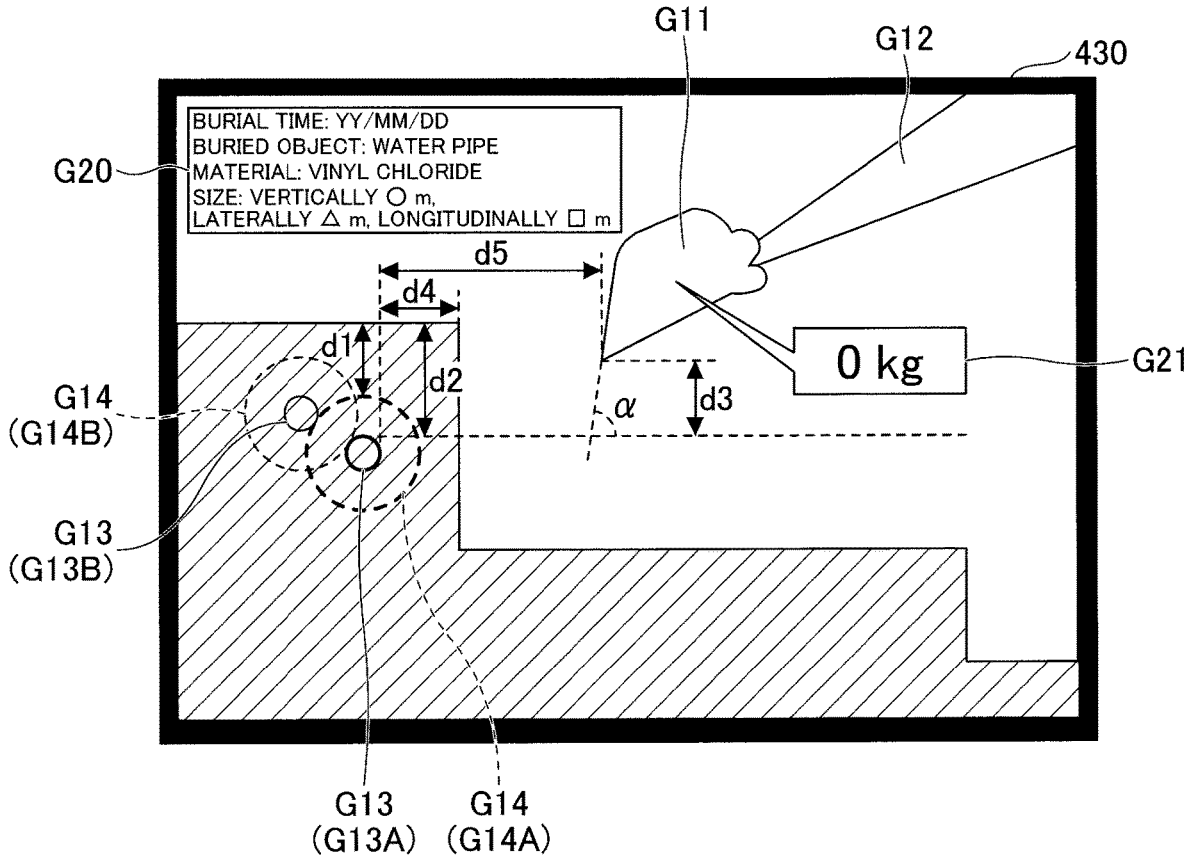
FIG. 8B is a diagram illustrating yet another example of the output image displayed during the guidance mode.
Figure 8C:
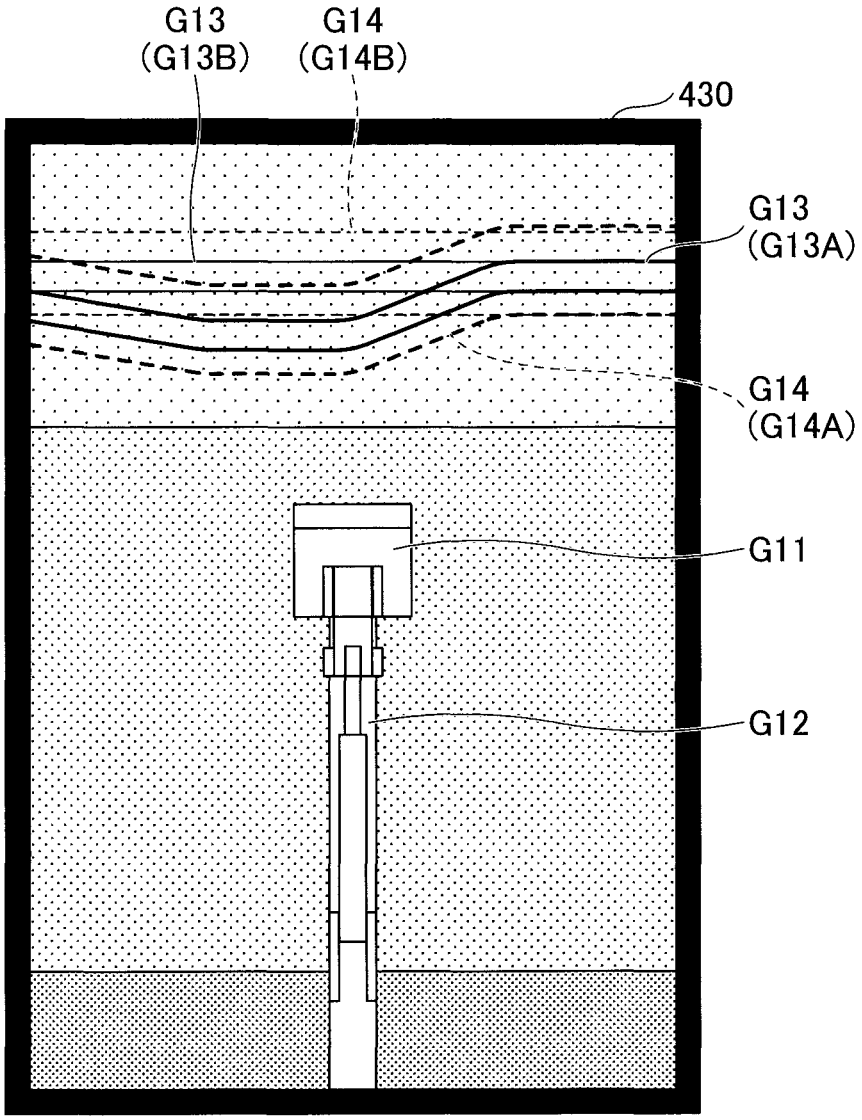
FIG. 8C is a diagram illustrating still another example of the output image displayed during the guidance mode.

Next, other examples of output images displayed during the guidance mode are described with reference to FIGS. 8A through 8C. FIGS. 8A through 8C schematically show the relationship between the bucket 6 and a buried object.

Buried objects such as water pipes in the ground are invisible. Therefore, the machine guidance device 50 obtains the position information of buried objects from the construction information. The construction information is stored in, for example, the storage device 47 or the like. The construction information may include, in addition to the position information of buried objects, information on a fixed ruler and two-dimensional or three-dimensional construction drawing data.

Specifically, FIGS. 8A and 8B schematically show the relationship between the attachment and the buried object as viewed from the side, using a bucket graphic shape G11, an arm graphic shape G12, a buried object graphic shape G13, and an approach limit line G14. The output image illustrated in FIG. 8B is different from the output image illustrated in FIG. 8A in that supplementary information is added. FIG. 8C schematically illustrates the relationship between the attachment and the buried object as viewed from above, using the bucket graphic shape G11, the arm graphic shape G12, the buried object graphic shape G13, and the approach limit line G14. The output images of FIGS. 8A through 8C, which are displayed on the work guidance display part 430 (see FIG. 6), may also be displayed in full screen in the image display part 41.

The buried object graphic shape G13 is a graphic shape that represents the position and size of a buried object. According to the illustration of FIGS. 8A through 8C, the buried object graphic shape G13 includes a buried object graphic shape G13A based on the buried object data as corrected in accordance with a detection value of the underground object detector E1 and a buried object graphic shape G13B based on the buried object data before the correction.

The approach limit line G14 is a graphic shape that represents the position and size of an approach limit area set around a buried object. According to the illustration of FIGS. 8A through 8C, like the buried object graphic shape G13, the approach limit line G14 includes an approach limit line G14A corresponding to the buried object graphic shape G13A based on the corrected buried object data and an approach limit line G14B facing the buried object graphic shape G13B based on the buried object data before the correction.

Even when no construction information is available (for example, even when no construction information is stored in the storage device 47), the machine guidance device 50 may display the buried object graphic shape G13A and the approach limit line G14A corresponding to the buried object graphic shape G13A, based on a detection value of the underground object detector E1, which is at least one of a stereo camera, a distance image sensor, a laser radar, an ultrasonic sensor, a LIDAR, etc.

The approach limit area is an area which the working part of the attachment is restricted from entering. For example, the machine guidance device 50 alerts the operator so that the working part of the attachment will not enter the approach limit area. Specifically, the information communicating part 53 may notify the operator of the size of the shortest distance between the teeth tips of the bucket 6 and an underground object, using, for example, intermittent sounds through the audio output device 43. In this case, the information communicating part 53 may reduce the interval between intermittent sounds as the shortest distance decreases. Furthermore, when the teeth tips of the bucket 6 enter the approach limit area, the information communicating part 53 may alarm the operator through the audio output device 43. The alarm is, for example, a sound significantly louder than the intermittent sounds. Furthermore, the same as in the case of presenting the size of the vertical distance between the teeth tips of the bucket 6 and the target work surface to the operator, the information communicating part 53 may present the size of the shortest distance between the teeth tips of the bucket 6 and an underground object, using a bar gauge such as the position indicator image 431.

According to the position indicator image 431 illustrated in FIG. 6, when the actual distance between the bucket 6 and the target work surface is within the predetermined range, the target segment G1 is displayed in a predetermined color different from the color of the other segments. Therefore, when a bar gauge is employed to present the buried object data, the target segment G1 may be display in a predetermined color different from the color of the other segments when the actual distance between the bucket 6 and a buried object is within a predetermined range. In this case, the target segment G1 may represent, for example, the position of the buried object or the position of the approach limit line of the buried object. Furthermore, the target segment G1 may represent the position of the upper end of the buried object. Furthermore, in the position indicator image 431, another target segment representing the position of the approach limit line of the buried object may be additionally displayed simultaneously with the target segment G1 representing the position of the buried object.

Furthermore, the machine guidance device 50 may automatically assist with the movement of the attachment so that the working part of the attachment will not enter the approach limit area. Specifically, for example, when the operator manually performs an arm closing operation, the automatic control part 54 invalidates the operation of the arm operating lever in response to determining that the teeth tips of the bucket 6 go on to enter the approach limit area. Alternatively, the automatic control part 54 may prevent the teeth tips of the bucket 6 from entering the approach limit area by automatically extending the boom cylinder 7 to raise the boom 4.

Simultaneous display of the corrected buried object graphic shape G13A and the buried object graphic shape G13B before correction makes it possible to show the operator how much the buried object is displaced from its original position or how the buried object is deformed in an easy-to-understand manner. By looking at such an image, the operator can estimate the displacements of other nearby buried objects. Furthermore, the operator can predict possible future displacements of buried objects. The machine guidance device 50, however, may omit display of the buried object graphic shape G13B before correction and its corresponding approach limit line G14B, in order to improve the visibility of the output image.

Furthermore, the machine guidance device 50 may display supplementary information represented by a dashed line, a double-headed arrow, etc., as illustrated in FIG. 8B. Examples of supplementary information include a secondary window G20 to display the details of the buried object data and a balloon image G21 to display information on an object of excavation loaded into the bucket 6. According to the illustration of FIG. 8B, the secondary window G20 displays the time of burial of the buried object, the type of the buried object, the material of the buried object, and the size of the buried object. The balloon image G21 indicates that no earth is loaded into the bucket 6 by displaying that the weight of earth loaded into the bucket 6 is 0 kg.

The supplementary information further includes a vertical distance d1 between the approach limit area and the ground surface above it, a vertical distance d2 between the buried object and the ground surface above it, a vertical distance d3 between the teeth tips of the bucket 6 and the buried object, a horizontal distance d4 between the buried object and the ground surface (wall face) on its shovel side, a horizontal distance d5 between the teeth tips of the bucket 6 and the buried object, and a bucket back surface angle α. The bucket back surface angle α is an angle formed between a virtual plane including the back surface of the bucket 6 and a virtual horizontal plane.

The supplementary information may include the horizontal displacement and the vertical displacement between the position of the buried object based on the buried object data before correction and the position of the buried object based on the corrected buried object data.

The machine guidance device 50 may project the output image as illustrated in FIG. 8C onto the ground, using a projector attached to the upper turning body 3. In this case, the output image is desirably projected such that the actual position of the buried object coincides with the display position of the buried object graphic shape G13 with the display of the bucket graphic shape G11 and the arm graphic shape G12 being omitted.

Thus, the shovel PS according to the embodiment of the present invention includes the lower traveling body 1; the upper turning body 3 turnably attached to the lower traveling body 1; an attachment attached to the upper turning body 3 and including the boom 4, the arm 5, and the bucket 6 serving as an end attachment; the boom angle sensor S1 serving as a boom state detector to detect the state of the boom 4; the arm angle sensor S2 serving as an arm state detector to detect the state of the arm 5; the bucket angle sensor S3 serving as an end attachment state detector to detect the state of the end attachment; and the machine guidance device 50 serving as a control device.

The position calculating part 51 of the machine guidance device 50, for example, obtains information on the position of the bucket 6 based on the respective outputs of the boom angle sensor S1, the arm angle sensor S2, and the bucket angle sensor S3.

Furthermore, the position calculating part 51 of the machine guidance device 50, for example, correlates the information on the position of the bucket 6 with information on the position of the underground object U1 obtained based on the output of the underground object detector E1. The underground object detector E1 may be mounted on, for example, a hand cart. This correlation includes, for example, a process for matching a first coordinate system with respect to the position of the bucket 6 and a second coordinate system with respect to the position of the underground object U1. This correlation typically includes a process of converting a group of coordinates with respect to the underground object U1 in the second coordinate system into a group of coordinates in the first coordinate system. This coordinate conversion process may be typically executed in the shovel PS (for example, the machine guidance device 50), but may also be executed outside the shovel PS (for example, in a management apparatus installed in a management center). In the case of executing the coordinate conversion process in the management apparatus, the machine guidance device 50 transmits information on the first coordinate system to the management apparatus, and the underground object detector E1 transmits the information on the position of the underground object U1 to the management apparatus. The machine guidance device 50 receives the information on the position of the underground object U1 from the management apparatus.

The distance calculating part 52 of the machine guidance device 50 calculates the distance between the bucket 6 and the underground object U1 based on the information on the position of the bucket 6 and the information on the position of the underground object U1.

Furthermore, the machine guidance device 50 so controls the shovel PS as to prevent the above-note distance from falling below a predetermined value. The machine guidance device 50 may notify the operator of the size of the shortest distance between the bucket 6 and the underground object U1, using, for example, intermittent sounds through the audio output device 43. Alternatively, the machine guidance device 50 may automatically extend or retract at least one of the boom cylinder 7, the arm cylinder 8, and the bucket cylinder 9 so that the above-describe distance will not fall below a predetermined value.

According to this configuration, the machine guidance device 50 can more reliably prevent damage to underground objects during excavation work. Therefore, the machine guidance device 50 can prevent the occurrence of work delay due to damage to buried objects. As a result, the machine guidance device 50 can reduce a work period. Furthermore, the machine guidance device 50 can notify the operator of the position of a buried object in an easy-to-understand manner to relieve the operator of the concern that the buried object may be accidentally damaged. Therefore, the mental stress of the operator can be reduced.

The underground object detector E1 may be installed in the shovel PS and be configured to output the information on the position of the underground object U1 to the machine guidance device 50. For example, the underground object detector E1 may be attached to the distal end of the arm 5 via the quick coupler 6*c*. According to this configuration, the machine guidance device 50 can obtain the information on the position of the underground object U1 directly from the underground object detector E1 without the intervention of a management center or the like. Furthermore, the machine guidance device 50 can derive a group of coordinates with respect to the underground object U1 in the same process as in the case of deriving the coordinates of the teeth tips of the bucket 6. Therefore, the machine guidance device 50 can easily correlate the information on the position of the bucket 6 with the information on the position of the underground object U1.

As illustrated in FIGS. 8A through 8C, the machine guidance device 50 may also be configured to display an image of an underground object. According to this configuration, the machine guidance device 50 can visually notify the operator of the shovel PS of the presence or absence of an underground object, the size and position of an underground object, the size of the distance between the bucket 6 and an underground object, etc. Therefore, the machine guidance device 50 can more reliably prevent damage to underground objects during excavation work.

The machine guidance device 50 may also be configured to display at least one of the value of the distance between the bucket 6 or the underground object detector E1 and an underground object, the value of the depth of an underground object from the ground level, the value of the depth of an underground object from the ground contact surface of the shovel PS, and the value of the depth of an underground object from an arbitrarily set reference plane.

The machine guidance device 50 may also be configured to display information on the type, size, time of burial (for example, date of burial), etc., of a buried object when information on the buried object is available in advance.

The machine guidance device 50 may also be configured to display information to which a worker should be alerted, if any, among information recorded during the past work, such as a position where a water pipe and a power line intersect.

The machine guidance device 50 may also be configured to display, when a disaster such as an earthquake, flood or the like has occurred to date since the date of burial of a buried object, information on the disaster, such as a seismic intensity or the date of occurrence of the disaster. By looking at such display, the operator can estimate the displacements of other nearby buried objects. Furthermore, the operator can predict possible future displacements of buried objects. In addition, the operator can predict possible damage to buried objects.

The machine guidance device 50 may also be configured to correct information on the position of a buried object stored in the storage device 47, based on the output of the underground object detector E1. According to this configuration, the machine guidance device 50 can, for example, increase the accuracy of the buried object data prestored in the storage device 47. Therefore, the machine guidance device 50 can more reliably prevent damage to an underground object when executing the machine guidance function or the machine control function using the buried object data.

The above-described correction of information on the position of a buried object may be performed in an external management apparatus. In the case of correcting information on the position of a buried object in a management apparatus, the information on the position of a buried object may be recorded in a storage part of the management apparatus. The management apparatus may correct the information on the position of a buried object based on the output of the underground object detector E1 received from the shovel PS. The management apparatus may transmit the corrected information on the position of a buried object to the machine guidance device 50.

The machine guidance device 50 may also be configured to display an image of a buried object such that the operator of the shovel PS can recognize the difference between the information on the position of the buried object stored in the storage device 47 and the information on the position of the buried object detected by the underground object detector E1. According to this configuration, the machine guidance device 50 can show the operator of the shovel PS how much the buried object is displaced from its original position or how the buried object is deformed in an easy-to-understand manner. By looking at such an image, the operator can estimate the displacements of other nearby buried objects. Furthermore, the operator can predict possible future displacements of buried objects.

The shovel PS may include the display device 40. A screen graphically representing the relative relationship between the bucket 6 serving as an end attachment and an underground object may be displayed on the display device 40. Furthermore, a graphic shape that moves in accordance with the movement of the bucket 6 may be displayed within the screen.

The shovel PS may include the audio output device 43. The shovel PS may also be configured such that the audio output of the audio output device 43 may change in accordance with the relative relationship between the bucket 6 serving as an end attachment and an underground object.

The management system SYS of the shovel PS according to the embodiment of the present invention is configured to manage the above-described shovel PS. Specifically, the management system SYS includes a management apparatus. The management apparatus, for example, obtains information on the position of the bucket 6 based on the respective outputs of the boom angle sensor S1, the arm angle sensor S2, and the bucket angle sensor S3. The management apparatus correlates the information on the position of the bucket 6 with information on the position of an underground object obtained based on the output of the underground object detector E1 to calculate the distance between the bucket 6 and the underground object. The machine guidance device 50 serving as a control device installed in the shovel PS is configured to so control the shovel PS as to prevent the distance from falling below a predetermined value. The machine guidance device 50 is, for example, configured to obtain the distance calculated by the management apparatus via the communications device T1. According to this configuration, the management system SYS can more reliably prevent damage to underground objects during excavation work by the shovel PS.

The management apparatus in the management system SYS may include a storage part. Underground objects may include a buried object. In this case, information on the position of the buried object may be stored in the storage part. The management apparatus may also be configured to correct the information on the position of the buried object based on the output of the underground object detector E1.

A preferred embodiment of the present invention is described above. The present invention, however, is not limited to the above-described embodiment. Various variations, replacements, etc., may be applied to the above-described embodiment without departing from the scope of the present invention. Furthermore, the features described with reference to the above-described embodiment may be suitably combined as long as causing no technical contradiction.

Figure 9:
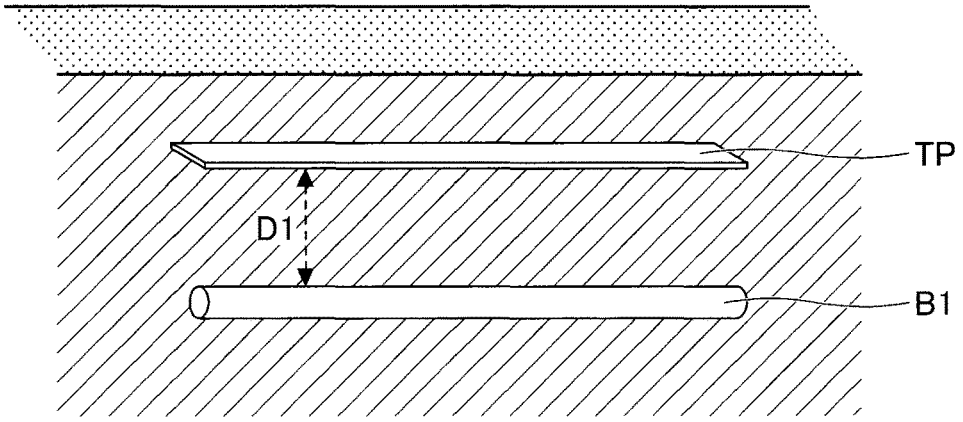
FIG. 9 is a diagram illustrating the relationship between a burial indicator sheet and a buried object.

For example, the machine guidance device 50 may also be configured to be able to display information on a burial indicator sheet TP as illustrated in FIG. 9 in the work guidance display part 430.

The burial indicator sheet TP, which is also referred to as a buried object tape, is a flexible member buried at a position higher (shallower) than the burial position of a buried object B1 such as a water pipe when the buried object B1 is buried, in order to prevent the shovel PS from causing accidents during excavation. Examples of accidents during excavation include an accident in which the buried object B1 is damaged by its contact with the bucket 6. The burial indicator sheet TP is typically buried at a position immediately above and higher (shallower) by a predetermined distance D1 (for example, several tens of centimeters) than the burial position of the buried object B1 as illustrated in FIG. 9. FIG. 9 is a diagram illustrating the relationship between the burial indicator sheet TP and the buried object B1, where the dot pattern represents the ground level and the area of oblique lines represents the ground. According to the illustration of FIG. 9, the burial indicator sheet TP has a structure in which metal foil such as aluminum foil is enclosed in a synthetic resin material such as polyethylene cloth by laminating so as to be electromagnetically detectable by the underground object detector E1. The burial indicator sheet TP, however, may also be constituted of a member including metal. Furthermore, the burial indicator sheet TP may also be constituted of a member that includes no metal, namely, a member that is not electromagnetically detectable by the underground object detector E1.

The machine guidance device 50 displays an output image including information on the burial indicator sheet TP in the work guidance display part 430 when detecting the burial indicator sheet TP (including aluminum foil) buried in the ground based on the output of the underground object detector E1.

The machine guidance device 50 may also display an output image including information on the burial indicator sheet TP in the work guidance display part 430 when detecting the burial indicator sheet TP that is dug out based on the output of at least one of a monocular camera, a stereo camera, a distance image sensor, an infrared sensor, an ultrasonic sensor, a metal detector, a LIDAR, etc. In this case, the burial indicator sheet TP may be constituted of a member that includes no metal.

Figure 10A:
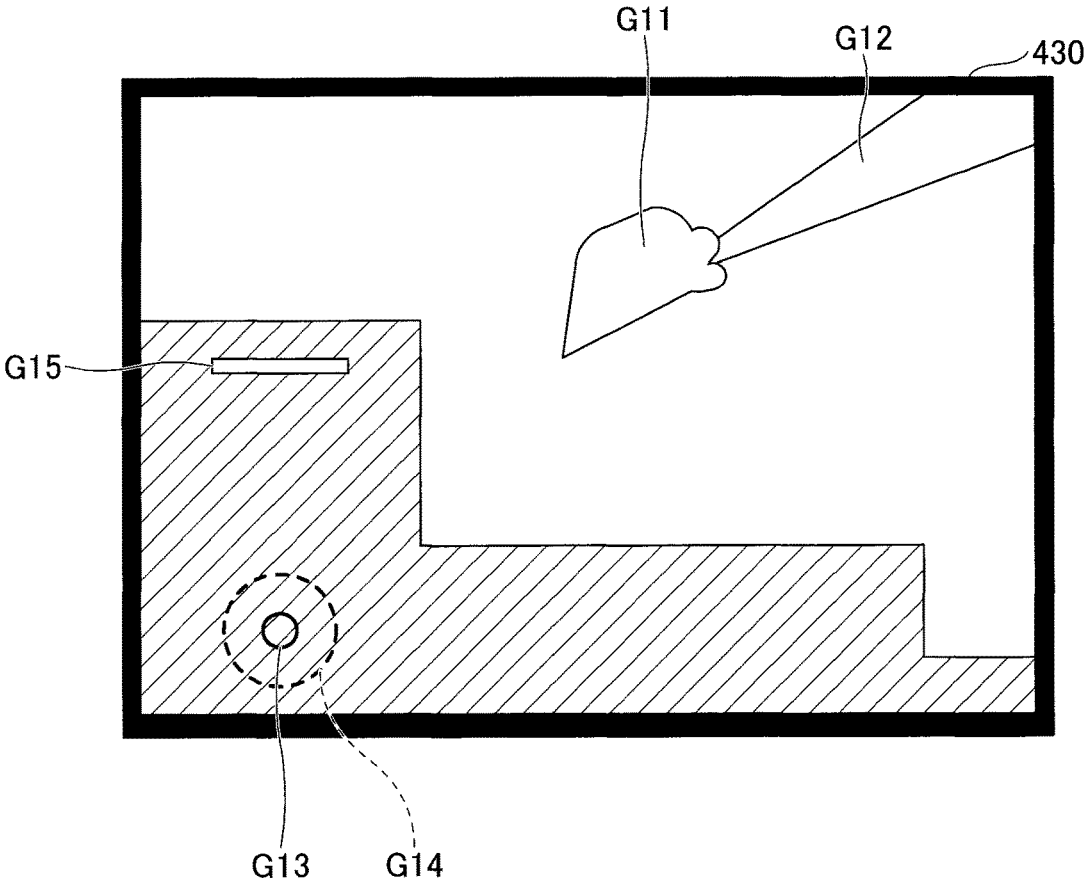
FIG. 10A is a diagram illustrating still another example of the output image displayed during the guidance mode.

Output images including information on the burial indicator sheet TP are, for example, output images schematically representing the relationship between the burial indicator sheet TP and the buried object B1, and include output images as illustrated in FIGS. 10A through 10G. FIGS. 10A through 100 are yet other examples of output images displayed during the guidance mode, and correspond to FIG. 8A.

Specifically, FIG. 10A illustrates the relationship between the position of the burial indicator sheet TP electromagnetically detected by the underground object detector E1 and the position of the buried object B1 based on the buried object data prestored in the storage device 47. More specifically, FIG. 10A schematically illustrates the relationship between the excavation attachment, the buried object S1, and the burial indicator sheet TP, using the bucket graphic shape G11, the arm graphic shape G12, the buried object graphic shape G13, the approach limit line G14, and a sheet graphic shape G15. The sheet graphic shape G15 is a graphic shape that represents the burial indicator sheet TP.

The machine guidance device 50 can make the operator of the shovel PS aware that the buried object B1 is buried immediately below the burial indicator sheet TP as indicated by the buried object data by displaying the output image illustrated in FIG. 10A in the work guidance display part 430.

Figure 10B:
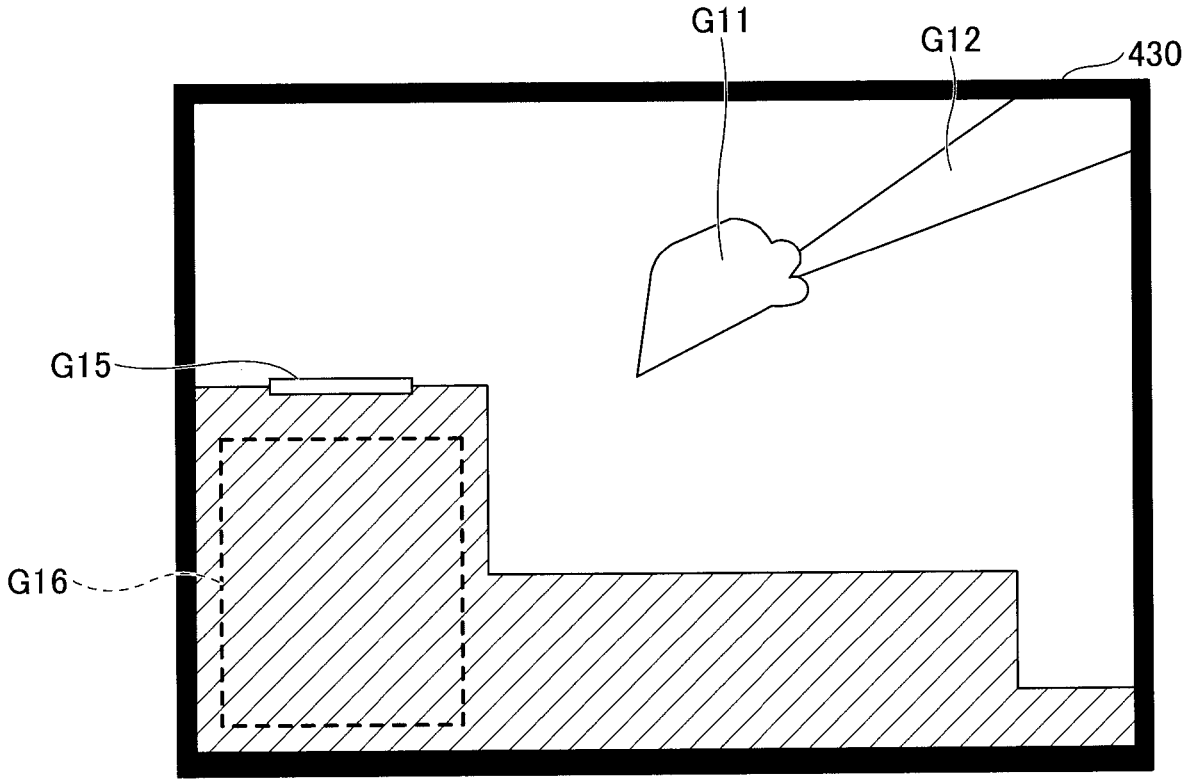
FIG. 10B is a diagram illustrating still another example of the output image displayed during the guidance mode.

FIG. 10B illustrates an example of the output image that is displayed when the burial indicator sheet TP exposed at the ground during excavation work is detected with a LIDAR or the like although the construction information includes no buried object data. Specifically, FIG. 10B schematically illustrates the relationship between the excavation attachment, the burial indicator sheet TP, and the buried object B1 that is likely to be present immediately below the burial indicator sheet TP, using the bucket graphic shape G11, the arm graphic shape G12, the sheet graphic shape G15, and a dashed line frame G16. The dashed line frame G16 is a graphic shape that represents a range where the buried object B1 is likely to be buried. According to the illustration of FIG. 10B, the dashed line frame G16 is so displayed as to correspond to a space wider than the burial indicator sheet TP.

The machine guidance device 50 can make the operator of the shovel PS aware that the buried object B1 not included in the construction information is likely to be buried immediately below the burial indicator sheet TP by displaying the output image illustrated in FIG. 10B in the work guidance display part 430.

Figure 10C:
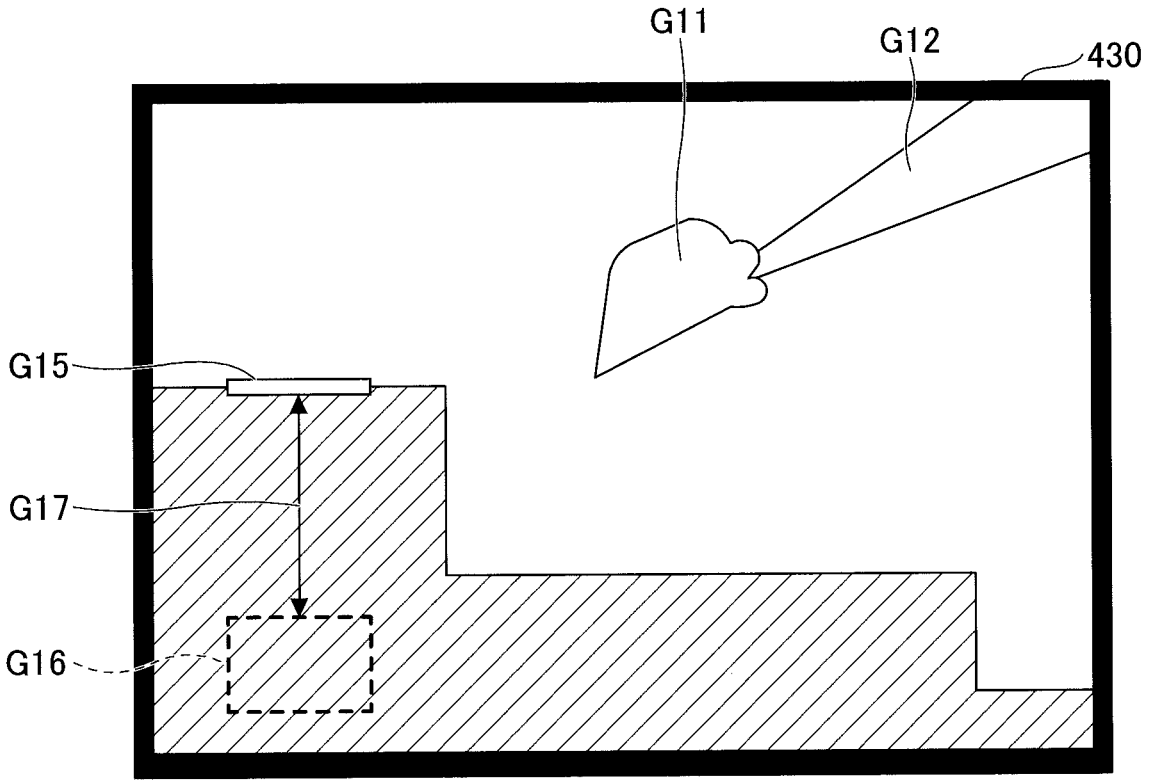
FIG. 10C is a diagram illustrating still another example of the output image displayed during the guidance mode.

FIG. 10C illustrates another example of the output image that is displayed when the burial indicator sheet TP exposed at the ground during excavation work is detected with a LIDAR or the like although the construction information includes no buried object data. Specifically, FIG. 10C schematically illustrates the relationship between the excavation attachment, the burial indicator sheet TP, and the buried object B1 that is likely to be present immediately below the burial indicator sheet TP, using the bucket graphic shape G11, the arm graphic shape G12, the sheet graphic shape G15, the dashed line frame G16, and a double-headed arrow G17. The double-headed arrow G17 is a graphic shape that represents the distance between the burial indicator sheet TP and the buried object B1. The double-headed arrow G17 may be displayed together with a numerical value that represents the distance. The distance represented by the double-headed arrow G17, which is typically several tens of centimeters, may be presettable as desired by the operator of the shovel PS.

The machine guidance device 50 can show the operator of the shovel PS the estimated position of the buried object B1 (not included in the construction information) that is likely to be buried immediately below the burial indicator sheet TP by displaying the output image illustrated in FIG. 10C in the work guidance display part 430.

Figure 11A:
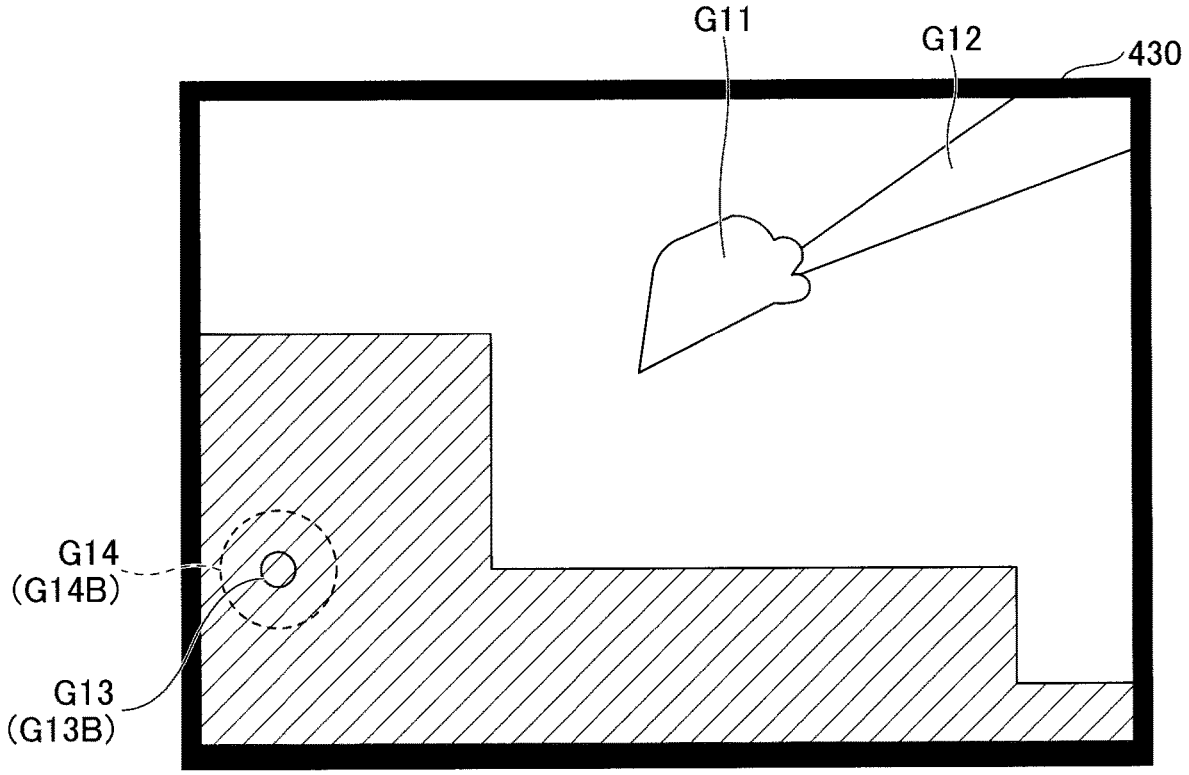
FIG. 11A is a diagram illustrating still another example of the output image displayed during the guidance mode.
Figure 11B:
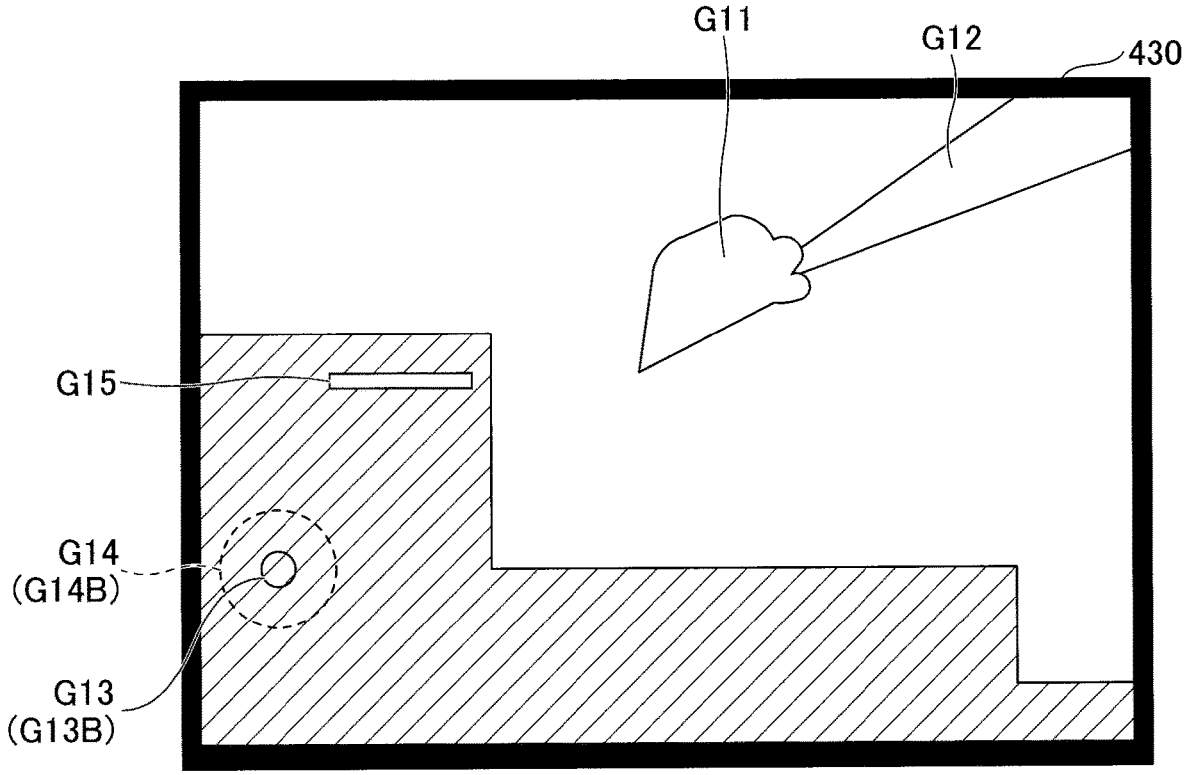
FIG. 11B is a diagram illustrating still another example of the output image displayed during the guidance mode.
Figure 11C:
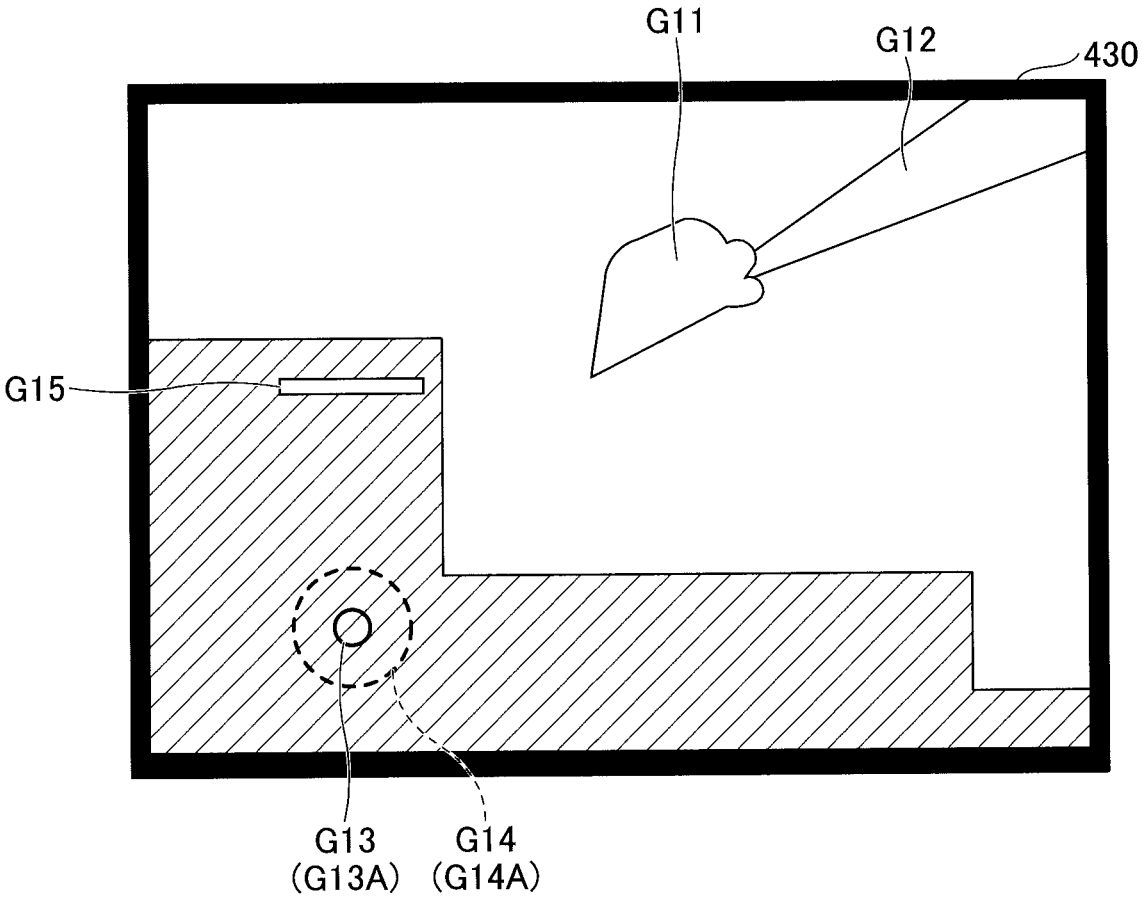
FIG. 11C is a diagram illustrating still another example of the output image displayed during the guidance mode.

The machine guidance device 50 may also be configured to correct the buried object data based on information on the position of the burial indicator sheet TP. FIGS. 11A through 11C are still other examples of output images displayed during the guidance mode, and correspond to FIG. 8A. FIGS. 11A through 11C illustrate the transition of output images displayed in the work guidance display part 430 when the machine guidance device 50 corrects the buried object data based on information on the position of the burial indicator sheet TP.

FIG. 11A illustrates an output image that is displayed before the underground object detector E1 electromagnetically detects the burial indicator sheet TP. Specifically, FIG. 11A illustrates the position of the buried object B1 based on the buried object data prestored in the storage device 47. More specifically, FIG. 11A schematically illustrates the relationship between the excavation attachment and the buried object B1, using the bucket graphic shape G11, the arm graphic shape G12, the buried object graphic shape G13B based on the buried object data before correction, and the approach limit line G14B based on the buried object data before correction.

FIG. 11B illustrates an output image that is displayed after the underground object detector E1 electromagnetically detects the burial indicator sheet TP. Specifically, FIG. 11B illustrates the relationship between the position of the burial indicator sheet TP electromagnetically detected by the underground object detector E1 and the position of the buried object B1 based on the buried object data prestored in the storage device 47. More specifically, FIG. 11B schematically illustrates the relationship between the excavation attachment, the burial indicator sheet TP, and the buried object B1, using the bucket graphic shape G11, the arm graphic shape G12, the buried object graphic shape G13B based on the buried object data before correction, the approach limit line G14B based on the buried object data before correction, and the sheet graphic shape G15.

FIG. 11C illustrates an output image that is displayed after the machine guidance device 50 corrects the buried object data based on a detection value of the underground object detector E1. The machine guidance device 50 determines whether the burial indicator sheet TP and the buried object B1 correspond based on the position of the burial indicator sheet TP electromagnetically detected by the underground object detector E1 and the position of the buried object B1 based on the buried object data prestored in the storage device 47. That is, the machine guidance device 50 determines whether what was buried together with the burial indicator sheet TP is the buried object B1 or another buried object. Specifically, the machine guidance device 50 determines that the burial indicator sheet TP and the buried object B1 correspond, for example, when the distance between the horizontal position of the central point of the burial indicator sheet TP and the horizontal position of the central point of the buried object B1 is less than or equal to a predetermined distance.

In response to determining that the burial indicator sheet TP and the buried object B1 correspond, the machine guidance device 50 corrects the buried object data such that the position of the buried object B1 is immediately below the burial indicator sheet TP detected by the underground object detector E1.

FIG. 11C schematically illustrates the relationship between the excavation attachment, the burial indicator sheet TP, and the buried object B1, using the bucket graphic shape G11, the arm graphic shape G12, the buried object graphic shape G13A based on the corrected buried object data, the approach limit line G14A based on the corrected buried object data, and the sheet graphic shape G15.

The machine guidance device 50 can make the operator of the shovel PS aware that there has been a displacement between the position of the buried object B1 based on the buried object data before correction and the actual position of the buried object B1 estimated from the position of the burial indicator sheet TP detected by the underground object detector E1 by displaying the series of output images illustrated in FIGS. 11A through 11C in the work guidance display part 430. By looking at such output images, the operator can estimate the displacements of other nearby buried objects. Furthermore, the operator can predict possible future displacements of buried objects.

Figure 12:
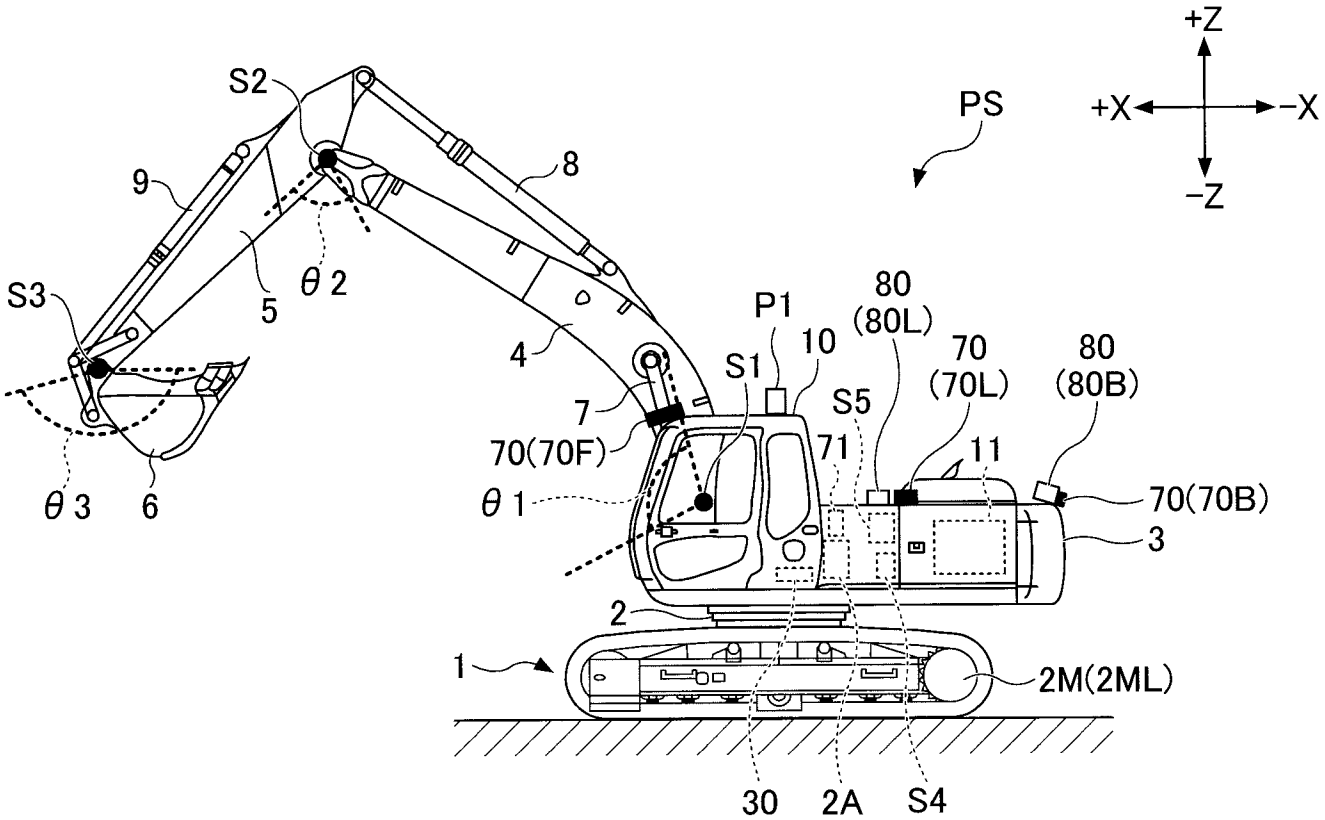
FIG. 12 is a side view of the shovel according to another embodiment of the present invention.
Figure 13:
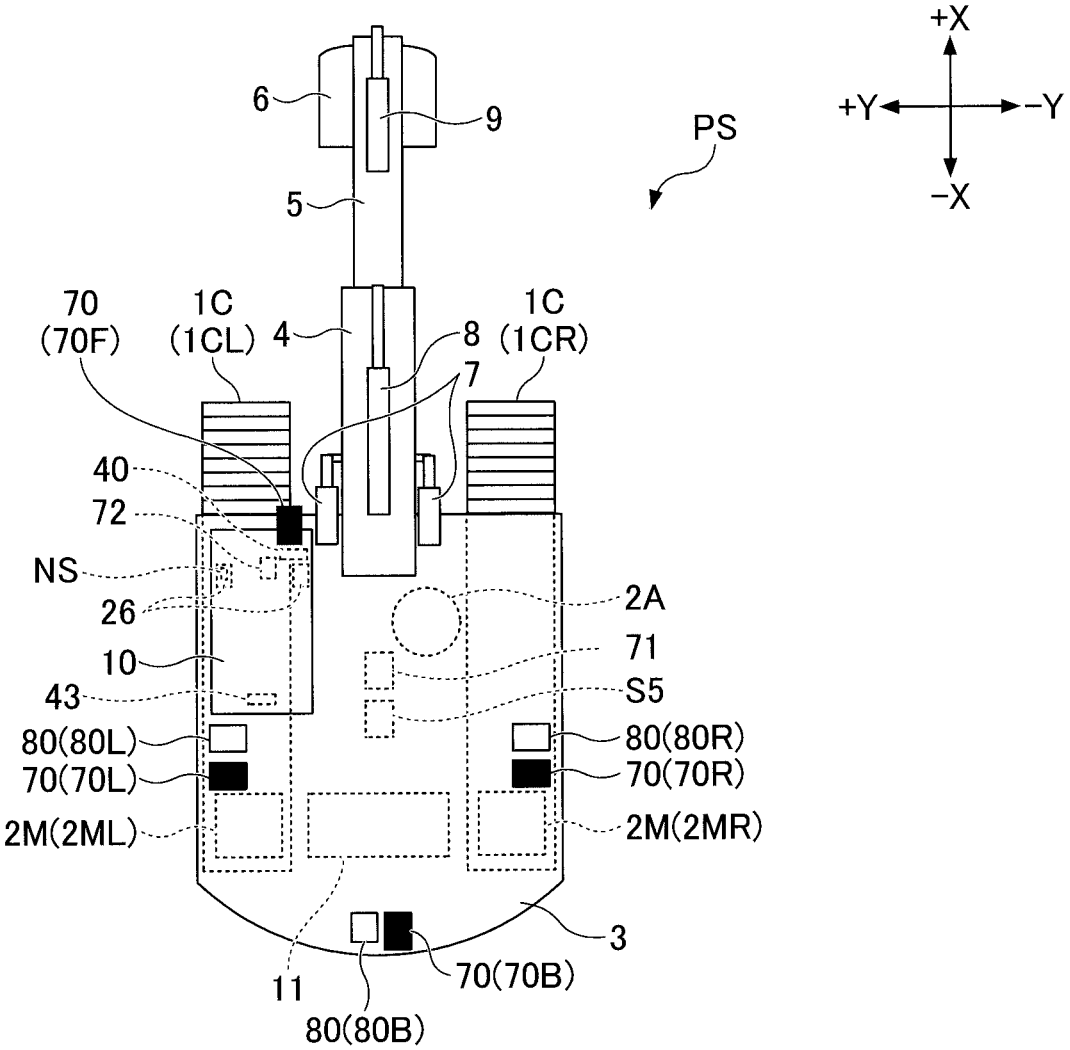
FIG. 13 is a plan view of the shovel of FIG. 12.
Figure 14:
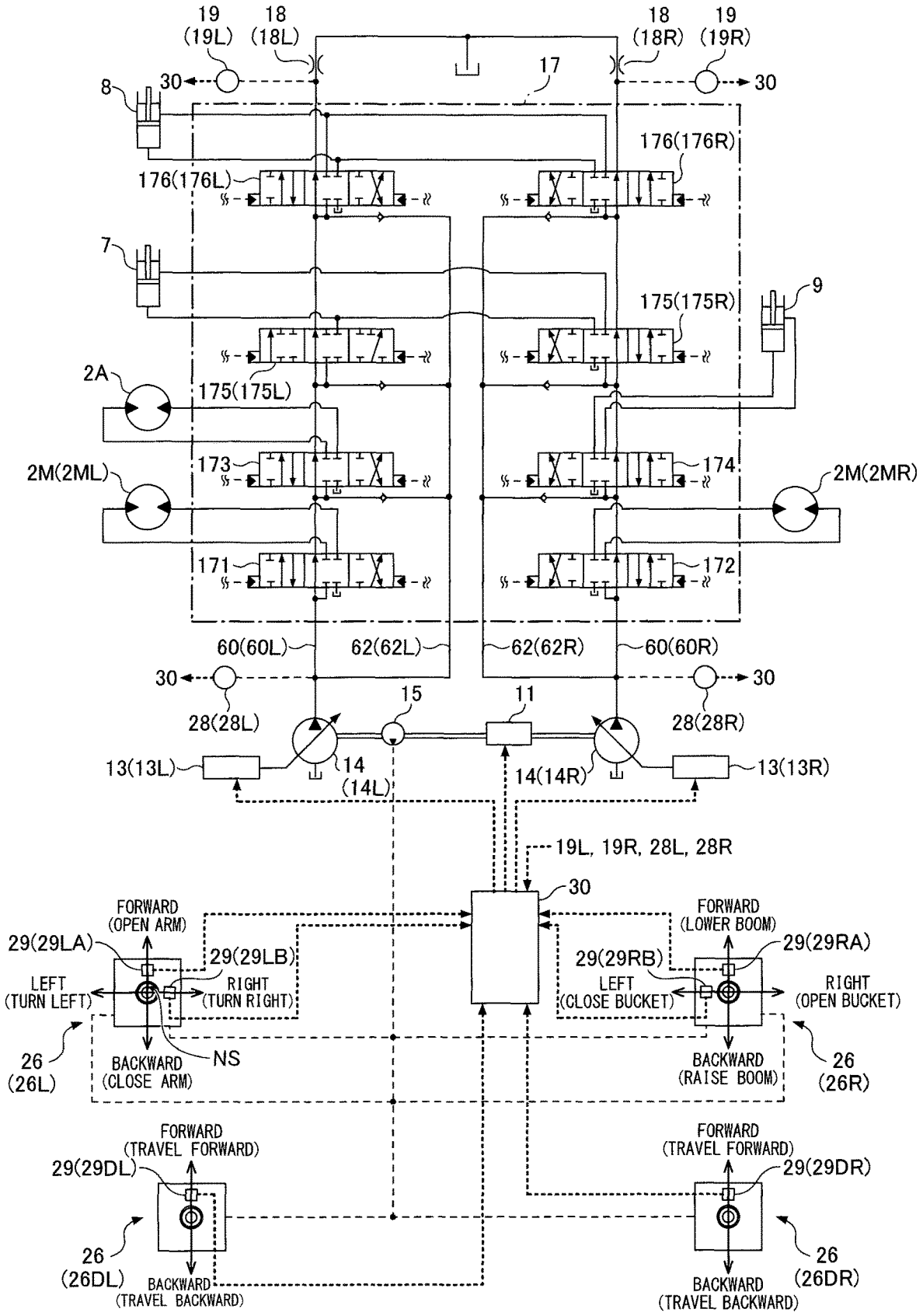
FIG. 14 is a diagram illustrating an example configuration of a hydraulic system installed in the shovel of FIG. 12.
Figure 15A:
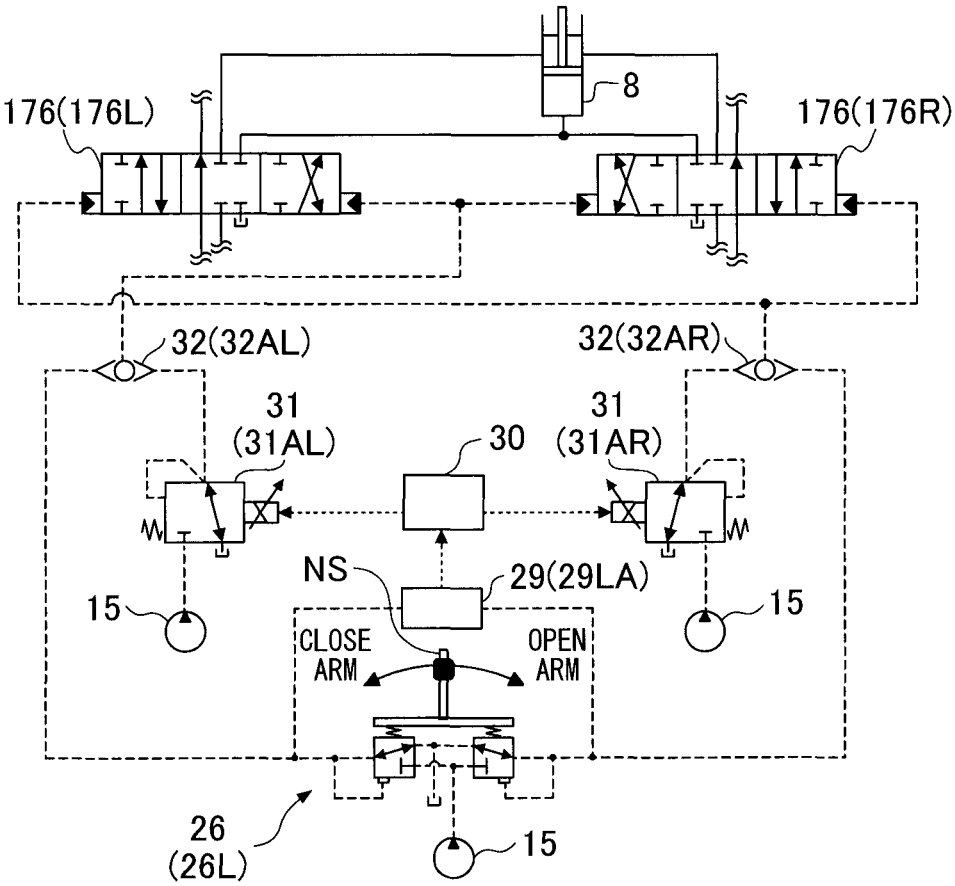
FIG. 15A is a diagram extracting part of the hydraulic system installed in the shovel of FIG. 12.
Figure 15B:
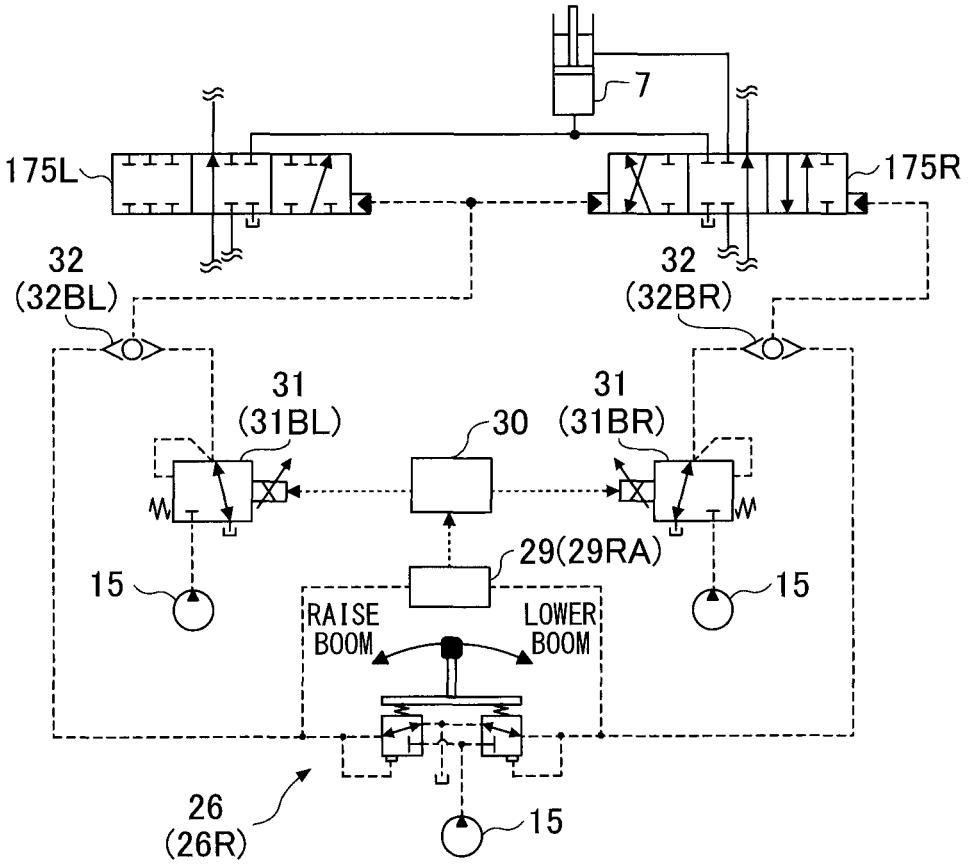
FIG. 15B is a diagram extracting part of the hydraulic system installed in the shovel of FIG. 12.
Figure 15C:
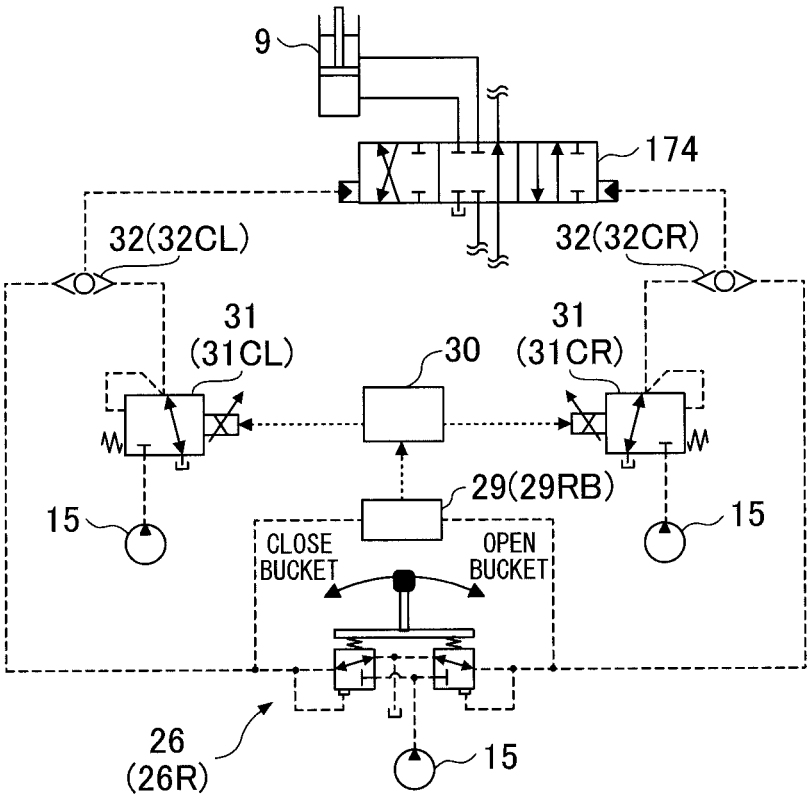
FIG. 15C is a diagram extracting part of the hydraulic system installed in the shovel of FIG. 12.
Figure 15D:
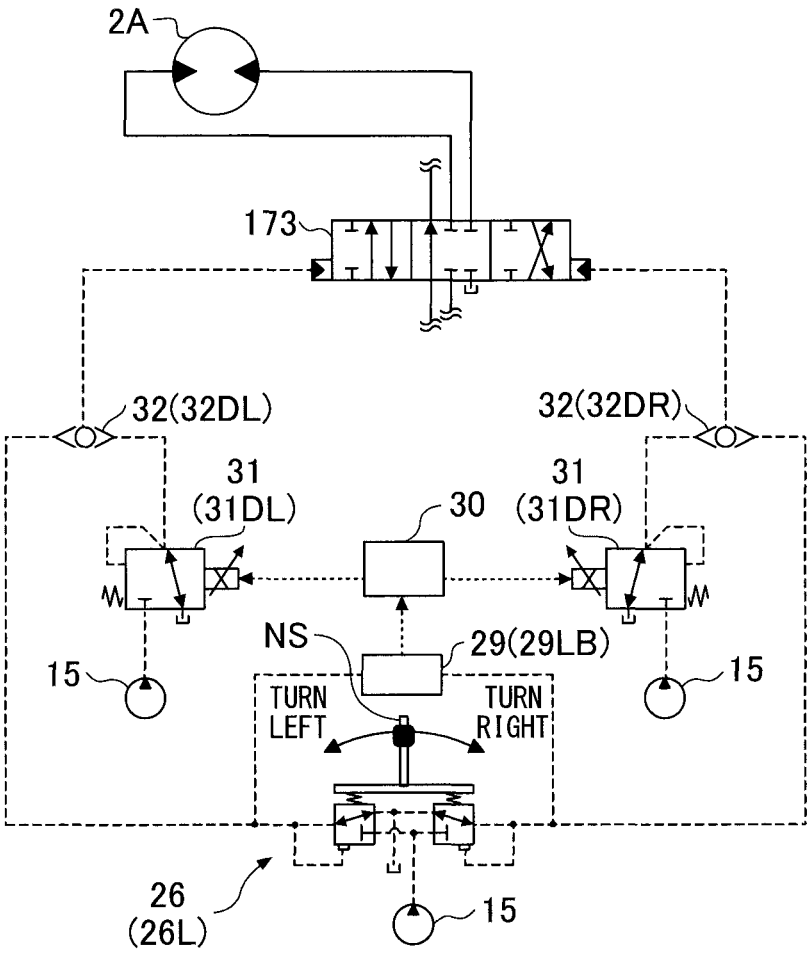
FIG. 15D is a diagram extracting part of the hydraulic system installed in the shovel of FIG. 12.
Figure 16:
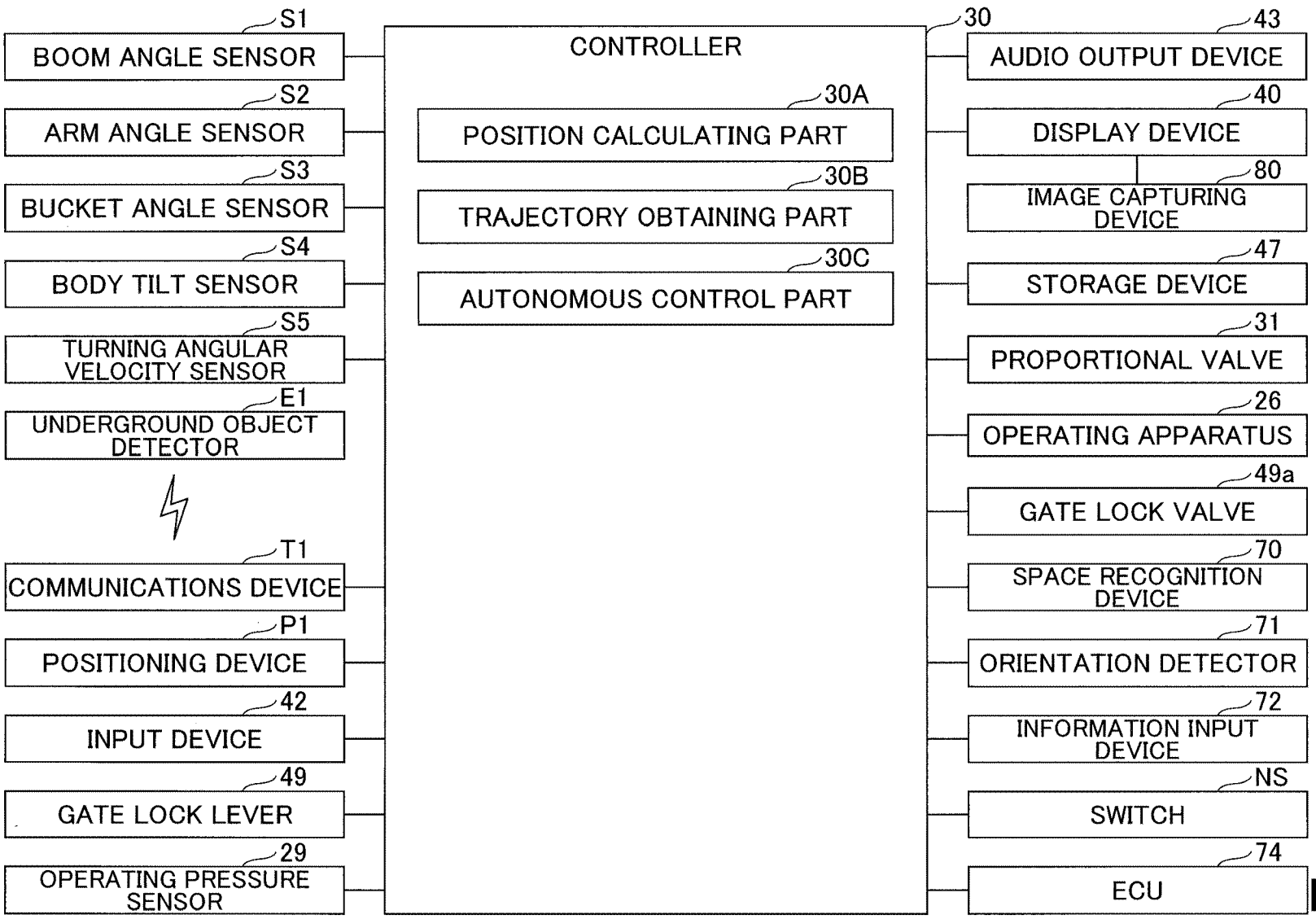
FIG. 16 is a functional block diagram of a controller.

The shovel PS may also be configured to be able to execute the machine control function to automatically assist with the operator's manual operation as illustrated in FIGS. 12 through 16. Furthermore, the shovel PS may also be configured to be able to detect an object present around the shovel PS. FIG. 12 is a side view of the shovel PS according to another embodiment of the present invention. FIG. 13 is a plan view of the shovel PS of FIG. 12. FIG. 14 is a diagram illustrating an example configuration of a hydraulic system installed in the shovel PS of FIG. 12. FIGS. 15A through 15D are diagrams extracting part of the hydraulic system installed in the shovel PS of FIG. 12. FIG. 16 is a functional block diagram of the controller 30 installed in the shovel PS of FIG. 12.

Specifically, the shovel PS is configured to be able to execute a speed limit function, a stop function, and an automatic avoidance function which serve as the machine control function. The speed limit function is a function to restrict the movement of the excavation attachment such that the travel speed of the working part of the excavation attachment is reduced when the working part approaches a buried object identified by the buried object data included in the construction information. The stop function is a function to stop the movement of the excavation attachment when the working part approaches the buried object. The automatic avoidance function is a function to cause the excavation attachment to automatically move in such a manner as to avoid the buried object so as to prevent the working part from contacting the buried object.

Furthermore, the shovel PS may also be configured to alarm, for example, in response to detecting an assistant worker working near a buried object, an obstacle, or the like within a predetermined range of distances from the shovel PS, at least one of the operator of the shovel PS and the assistant worker. In this case, the shovel PS may also be configured to automatically stop the movement of the upper turning body 3 and the movement of the excavation attachment.

Furthermore, the shovel PS may also be configured to be able to execute at least one of the machine guidance function and the machine control function with respect to a buried object and, in response to detecting an object such as an assistant worker around the shovel PS, execute at least one of the speed limit function, the stop function, and the automatic avoidance function with respect to the object.

According to the illustration of FIG. 12, the lower traveling body 1 of the shovel PS includes crawlers 10. The crawlers 10 are driven by travel hydraulic motors 2M serving as travel actuators installed in the lower traveling body 1. Specifically, the crawlers 10 include a left crawler 1CL and a right crawler 1CR. The left crawler 1CL is driven by a left travel hydraulic motor 2ML, and the right crawler 1CR is driven by a right travel hydraulic motor 2MR.

The upper turning body 3 is turnably mounted on the lower traveling body 1 via the turning mechanism 2. The turning mechanism 2 is driven by a turning hydraulic motor 2A serving as a turning actuator mounted on the upper turning body 3. The turning actuator, however, may be a turning electric motor serving as an electric actuator.

The boom 4 is attached to the upper turning body 3. The arm 5 is attached to the distal end of the boom 4. The bucket 6 serving as an end attachment is attached to the distal end of the arm 5. The boom 4, the arm 5, and the bucket 6 constitute an excavation attachment that is an example of the attachment. The boom 4 is driven by the boom cylinder 7, the arm 5 is driven by the arm cylinder 8, and the bucket 6 is driven by the bucket cylinder 9. The boom cylinder 7, the arm cylinder 8, and the bucket cylinder 9 constitute an attachment actuator.

The boom 4 is so supported as to be vertically pivotable relative to the upper turning body 3. The boom angle sensor S1 is attached to the boom 4. The boom angle sensor S1 can detect a boom angle θ1 that is the pivot angle of the boom 4. The boom angle θ1 is, for example, a climb angle from the lowermost position of the boom 4. Therefore, the boom angle θ1 maximizes when the boom 4 is raised most.

The arm 5 is so supported as to be pivotable relative to the boom 4. The arm angle sensor S2 is attached to the arm 5. The arm angle sensor S2 can detect an arm angle θ2 that is the pivot angle of the arm 5. The arm angle θ2 is, for example, an opening angle from the most closed position of the arm 5. Therefore, the a it angle θ2 maximizes when the arm 5 is most open.

The bucket 6 is so supported as to be pivotable relative to the arm 5. The bucket angle sensor S3 is attached to the bucket 6. The bucket angle sensor S3 can detect a bucket angle θ3 that is the pivot angle of the bucket 6. The bucket angle θ3 is an opening angle from the most closed position of the bucket 6. Therefore, the bucket angle θ3 maximizes when the bucket 6 is most open.

According to the embodiment of FIG. 12, each of the boom angle sensor S1, the arm angle sensor S2, and the bucket angle sensor S3 is constituted of a combination of an acceleration sensor and a gyroscope, but may alternatively be constituted of an acceleration sensor alone. Furthermore, the boom angle sensor S1 may alternatively be a stroke sensor attached to the boom cylinder 7 or may alternatively be a rotary encoder, a potentiometer, an inertial measurement unit or the like. The same is true for the arm angle sensor S2 and the bucket angle sensor S3.

The cabin 10 serving as a cab is provided and a power source such as the engine 11 is mounted on the upper turning body 3. A space recognition device 70, an orientation detector 71, the image capturing device 80, the positioning device P1, the body tilt sensor S4, a turning angular velocity sensor S5, etc., are attached to the upper turning body 3. The operating apparatus 26, the controller 30, an information input device 72, the display device 40, the audio output device 43, etc., are provided in the cabin 10. In this specification, for convenience, the side of the upper turning body 3 on which the excavation attachment is attached is defined as the front side, and the side of the upper turning body 3 on which the counterweight is attached is defined as the back side.

The space recognition device 70 is configured to recognize an object present in a three-dimensional space around the shovel PS. Furthermore, the space recognition device 70 may also be configured to calculate the distance from the space recognition device 70 or the shovel PS to the recognized object. Examples of the space recognition device 70 include an ultrasonic sensor, a millimeter wave radar, a monocular camera, a stereo camera, a LIDAR, a distance image sensor, and an infrared sensor. According to the example illustrated in FIGS. 12 and 13, the space recognition device 70 includes a front sensor 70F attached to the front end of the upper surface of the cabin 10, a back sensor 70B attached to the back end of the upper surface of the upper turning body 3, a left sensor 70L attached to the left end of the upper surface of the upper turning body 3, and a right sensor 70R attached the right end of the upper surface of the upper turning body 3. A top sensor to recognize an object present in a space above the upper turning body 3 may be attached to the shovel PS.

The orientation detector 71 is configured to detect information on the relative relationship between the orientation of the upper turning body 3 and the orientation of the lower traveling body 1. The orientation detector 71 may be constituted of, for example, of a combination of a geomagnetic sensor attached to the lower traveling body 1 and a geomagnetic sensor attached to the upper turning body 3. The orientation detector 71 may alternatively be constituted of a combination of a GNSS receiver attached to the lower traveling body 1 and a GNSS receiver attached to the upper turning body 3. The orientation detector 71 may alternatively be a rotary encoder, a rotary position sensor, or the like. According to a configuration where the upper turning body 3 is driven to turn by a turning motor generator, the orientation detector 71 may be constituted of a resolver. The orientation detector 71 may be attached to, for example, a center joint provided in relation to the turning mechanism 2 that achieves relative rotation between the lower traveling body 1 and the upper turning body 3.

The orientation detector 71 may alternatively be constituted of a camera attached to the upper turning body 3. In this case, the orientation detector 71 performs known image processing on an image captured by a camera attached to the upper turning body 3 (an input image) to detect an image of the lower traveling body 1 included in the input image. The orientation detector 71 identifies a longitudinal direction of the lower traveling body 1 by detecting an image of the lower traveling body 1 using a known image recognition technique. The orientation detector 71 derives an angle formed between the direction of the longitudinal axis of the upper turning body 3 and the longitudinal direction of the lower traveling body 1. The direction of the longitudinal axis of the upper turning body 3 is derived from the attachment position of the camera. In particular, the crawlers 1C protrude from the upper turning body 3. Therefore, the orientation detector 71 can identify a longitudinal direction of the lower traveling body 1 by detecting an image of the crawlers 1C. In this case, the orientation detector 71 may be integrated with the controller 30.

The information input device 72 is so configured as to enable the shovel operator to input information to the controller 30. According to the example illustrated in FIGS. 12 and 13, the information input device 72 is a switch panel installed near the image display part 41 of the display device 40. The information input device 72, however, may alternatively be a touchscreen placed over the image display part 41 of the display device 40 or an audio input device such as a microphone placed in the cabin 10.

The image capturing device 80 captures an image of an area surrounding the shovel PS. According to the example illustrated in FIGS. 12 and 13, the image capturing device 80 includes the back camera 80B attached to the back end of the upper surface of the upper turning body 3, the left camera 80L attached to the left end of the upper surface of the upper turning body 3, and the right camera 80R attached to the right end of the upper surface of the upper turning body 3. The image capturing device 80 may also include a front camera.

The back camera 80B is placed next to the back sensor 70B, the left camera 80L is placed next to the left sensor 70L, and the right camera 80R is placed next to the right sensor 70R. The front camera may be placed next to the front sensor 70F.

An image captured by the image capturing device 80 is displayed on the display device 40 installed in the cabin 10. The image capturing device 80 may also be configured to be able to display a viewpoint change image such as an overhead view image on the display device 40. For example, an overhead view image is generated by synthesizing the respective output images of the back camera 80B, the left camera 80L, and the right camera 80R.

According to this configuration, the shovel PS can display an image of an object detected by the space recognition device 70 on the display device 40. Therefore, when the movement of a driven body such as the excavation attachment is restricted or stopped, the operator of the shovel PS can immediately identify a causative object by looking at an image displayed on the display device.

The positioning device P1 is configured to measure the position of the upper turning body 3. According to the example illustrated in FIG. 12, the positioning device P1 is a GNSS receiver, and detects the position of the upper turning body 3 to output a detection value to the controller 30. The positioning device P1 may be a GNSS compass. In this case, the positioning device P1 can detect the position and the orientation of the upper turning body 3.

The body tilt sensor S4 detects the inclination of the upper turning body 3 relative to a predetermined plane. According to the example illustrated in FIG. 12, the body tilt sensor S4 is an acceleration sensor that detects the tilt angle of the upper turning body 3 around its longitudinal axis and the tilt angle of the upper turning body 3 around its lateral axis relative to a horizontal plane. For example, the longitudinal axis and the lateral axis of the upper turning body 3 are perpendicular to each other and pass the shovel center point that is a point on the turning axis of the shovel PS.

The turning angular velocity sensor S5 detects the turning angular velocity of the upper turning body 3. According to the example illustrated in FIG. 12, the turning angular velocity sensor S5 is a gyroscope, but may alternatively be a resolver, a rotary encoder, or the like. The turning angular velocity sensor S5 may also detect a turning speed. The turning speed may be calculated from a turning angular velocity.

In the following, at least one of the boom angle sensor S1, the arm angle sensor S2, the bucket angle sensor S3, the body tilt sensor S4, and the turning angular velocity sensor S5 is also referred to as a posture detector. The posture of the excavation attachment is detected based on, for example, the respective outputs of the boom angle sensor S1, the arm angle sensor S2, and the bucket angle sensor S3.

The display device 40 is a device that displays information. According to the example illustrated in FIG. 12, the display device 40 is a liquid crystal display installed in the cabin 10. The display device 40, however, may also be the display of a portable terminal such as a smartphone.

The audio output device 43 is a device that outputs audio. The audio output device 43 includes at least one of a device that outputs audio to the operator in the cabin 10 and a device that outputs audio to a worker outside the cabin 10. The audio output device 43 may be the loudspeaker of a portable terminal.

The operating apparatus 26 is an apparatus that the operator uses to operate actuators.

The controller 30 is a control device for controlling the shovel PS. According to the example illustrated in FIG. 12, the controller 30 is constituted of a computer including a CPU, a volatile storage device, and a nonvolatile storage device. The controller 30 reads programs corresponding to functions from the nonvolatile storage device, loads the programs into the volatile storage device, and causes the CPU to execute corresponding processes. Examples of functions include the machine guidance function to provide the operator with guidance (directions) on manually operating the shovel PS and the machine control function to assist the operator in manually operating the shovel PS or cause the shovel PS to automatically or autonomously operate.

Next, an example configuration of the hydraulic system installed in the shovel PS is described with reference to FIG. 14. FIG. 14 is a diagram illustrating an example configuration of the hydraulic system installed in the shovel PS. In FIG. 14, a mechanical power transmission system, a hydraulic oil line, a pilot line, and an electrical control system are indicated by a double line, a solid line, a dashed line, and a dotted line, respectively.

The hydraulic system of the shovel PS mainly includes the engine 11, the regulator 13, the main pump 14, the pilot pump 15, the control valve 17, the operating apparatus 26, the discharge pressure sensor 28, the operating pressure sensor 29, and the controller 30.

According to FIG. 14, the hydraulic system is configured such that hydraulic oil can be circulated from the main pump 14 driven by the engine 11 to a hydraulic oil tank via a center bypass conduit 60 or a parallel conduit 62.

The engine 11 is a drive source of the shovel PS. According to the example illustrated in FIG. 14, the engine 11 is, for example, a diesel engine that so operates as to maintain a predetermined rotational speed. The output shaft of the engine 11 is coupled to the input shafts of the main pump 14 and the pilot pump 15.

The main pump 14 is so configured as to be able to supply hydraulic oil to the control valve 17 via a hydraulic oil line. According to the example illustrated in FIG. 14, the main pump 14 is a swash plate variable displacement hydraulic pump.

The regulator 13 is so configured as to be able to control the discharge quantity of the main pump 14. According to the example illustrated in FIG. 14, the regulator 13 controls the discharge quantity of the main pump 14 by adjusting the swash plate tilt angle of the main pump 14 in response to a control command from the controller 30.

The pilot pump 15 is so configured as to be able to supply hydraulic oil to hydraulic control apparatuses including the operating apparatus 26 via a pilot line. According to the example illustrated in FIG. 14, the pilot pump 15 is a fixed displacement hydraulic pump.

The control valve 17 is a hydraulic control device that controls the hydraulic system in the shovel PS. According to the example illustrated in FIG. 14, the control valve 17 includes control valves 171 through 176. The control valve 175 includes a control valve 175L and a control valve 175R. The control valve 176 includes a control valve 176L and a control valve 176R. The control valve 17 is so configured as to be able to selectively supply hydraulic oil discharged by the main pump 14 to one or more hydraulic actuators through the control valves 171 through 176. The control valves 171 through 176 control, for example, the flow rate of hydraulic oil flowing from the main pump 14 to hydraulic actuators and the flow rate of hydraulic oil flowing from hydraulic actuators to the hydraulic oil tank. The hydraulic actuators include the boom cylinder 7, the arm cylinder 8, the bucket cylinder 9, the left travel hydraulic motor 2ML, the right travel hydraulic motor 2MR, and the turning hydraulic motor 2A.

The operating apparatus 26 is an apparatus that the operator uses to operate actuators. The operating apparatus 26 includes, for example, operating levers and operating pedals. The actuators include at least one of a hydraulic actuator and an electric actuator. According to the example illustrated in FIG. 14, the operating apparatus 26 is so configured as to be able to supply hydraulic oil discharged by the pilot pump 15 to a pilot port of a corresponding control valve in the control valve 17 through a pilot line. The pressure of hydraulic oil supplied to each pilot port (pilot pressure) is a pressure commensurate with the direction of operation and the amount of operation of the operating apparatus 26 for a corresponding hydraulic actuator. The operating apparatus 26, however, may alternatively be an electrical control type instead of the above-described pilot pressure type. In this case, the control valves in the control valve 17 may be electromagnetic solenoid spool valves.

The discharge pressure sensor 28 is so configured as to be able to detect the discharge pressure of the main pump 14. According to the example illustrated in FIG. 14, the discharge pressure sensor 28 outputs a detected value to the controller 30.

The operating pressure sensor 29 is so configured as to be able to detect the details of the operator's operation of the operating apparatus 26. According to the example illustrated in FIG. 14, the operating pressure sensor 29 detects the direction of operation and the amount of operation of the operating apparatus 26 corresponding to each actuator in the form of pressure (operating pressure), and outputs the detected value to the controller 30. The details of the operation of the operating apparatus may alternatively be detected using a sensor other than an operating pressure sensor.

The main pump 14 includes a left main pump 14L and a right main pump 14R. The left main pump 14L circulates hydraulic oil to the hydraulic oil tank through a left center bypass conduit 60L or a left parallel conduit 62L. The right main pump 14R circulates hydraulic oil to the hydraulic oil tank through a right center bypass conduit 60R or a right parallel conduit 62R.

The left center bypass conduit 60L is a hydraulic oil line that passes through the control valves 171, 173, 175L and 176L placed in the control valve 17. The right center bypass conduit 60R is a hydraulic oil line that passes through the control valves 172, 174, 175R and 176R placed in the control valve 17.

The control valve 171 is a spool valve that switches the flow of hydraulic oil in order to supply hydraulic oil discharged by the left main pump 14L to the left travel hydraulic motor 2ML and to discharge hydraulic oil discharged by the left travel hydraulic motor 2ML to the hydraulic oil tank.

The control valve 172 is a spool valve that switches the flow of hydraulic oil in order to supply hydraulic oil discharged by the right main pump 14R to the right travel hydraulic motor 2MR and to discharge hydraulic oil discharged by the right travel hydraulic motor 2MR to the hydraulic oil tank.

The control valve 173 is a spool valve that switches the flow of hydraulic oil in order to supply hydraulic oil discharged by the left main pump 14L to the turning hydraulic motor 2A and to discharge hydraulic oil discharged by the turning hydraulic motor 2A to the hydraulic oil tank.

The control valve 174 is a spool valve that switches the flow of hydraulic oil in order to supply hydraulic oil discharged by the right main pump 14R to the bucket cylinder 9 and to discharge hydraulic oil in the bucket cylinder 9 to the hydraulic oil tank.

The control valve 175L is a spool valve that switches the flow of hydraulic oil in order to supply hydraulic oil discharged by the left main pump 14L to the boom cylinder 7. The control valve 175R is a spool valve that switches the flow of hydraulic oil in order to supply hydraulic oil discharged by the right main pump 14R to the boom cylinder 7 and to discharge hydraulic oil in the boom cylinder 7 to the hydraulic oil tank.

The control valve 176L is a spool valve that switches the flow of hydraulic oil in order to supply hydraulic oil discharged by the left main pump 14L to the arm cylinder 8 and to discharge hydraulic oil in the arm cylinder 8 to the hydraulic oil tank.

The control valve 176R is a spool valve that switches the flow of hydraulic oil in order to supply hydraulic oil discharged by the right main pump 14R to the arm cylinder 8 and to discharge hydraulic oil in the arm cylinder 8 to the hydraulic oil tank.

The left parallel conduit 62L is a hydraulic oil line parallel to the left center bypass conduit 60L. When the flow of hydraulic oil through the left center bypass conduit 60L is restricted or blocked by any of the control valves 171, 173 and 175L, the left parallel conduit 62L can supply hydraulic oil to a control valve further downstream. The right parallel conduit 62R is a hydraulic oil line parallel to the right center bypass conduit 60R. When the flow of hydraulic oil through the right center bypass conduit 60R is restricted or blocked by any of the control valves 172, 174 and 175R, the right parallel conduit 62R can supply hydraulic oil to a control valve further downstream.

The regulator 13 includes a left regulator 13L and a right regulator 13R. The left regulator 13L controls the discharge quantity of the left main pump 14L by adjusting the swash plate tilt angle of the left main pump 14L in accordance with the discharge pressure of the left main pump 14L. Specifically, the left regulator 13L, for example, reduces the discharge quantity of the left main pump 14L by adjusting its swash plate tilt angle, according as the discharge pressure of the left main pump 14L increases. The same is the case with the right regulator 13R. This is for preventing the absorbed power of the main pump 14 expressed by the product of the discharge pressure and the discharge quantity from exceeding the output power of the engine 11.

The operating apparatus 26 includes a left operating lever 26L, a right operating lever 26R, and a travel lever 26D. The travel lever 26D includes a left travel lever 26DL and a right travel lever 26DR.

The left operating lever 26L is used for a turning operation and for operating the arm 5. When operated forward or backward, the left operating lever 26L introduces a control pressure commensurate with the amount of lever operation to a pilot port of the control valve 176, using hydraulic oil discharged by the pilot pump 15. When operated rightward or leftward, the left operating lever 26L introduces a control pressure commensurate with the amount of lever operation to a pilot port of the control valve 173, using hydraulic oil discharged by the pilot pump 15.

Specifically, when operated in an arm closing direction, the left operating lever 26L introduces hydraulic oil to the right side pilot port of the control valve 176L and introduces hydraulic oil to the left side pilot port of the control valve 176R. Furthermore, when operated in an arm opening direction, the left operating lever 26L introduces hydraulic oil to the left side pilot port of the control valve 176L and introduces hydraulic oil to the right side pilot port of the control valve 176R. Furthermore, when operated in a left turning direction, the left operating lever 26L introduces hydraulic oil to the left side pilot port of the control valve 173, and when operated in a right turning direction, the left operating lever 26L introduces hydraulic oil to the right side pilot port of the control valve 173.

The right operating lever 26R is used to operate the boom 4 and operate the bucket 6. When operated forward or backward, the right operating lever 26R introduces a control pressure commensurate with the amount of lever operation to a pilot port of the control valve 175, using hydraulic oil discharged by the pilot pump 15. When operated rightward or leftward, the right operating lever 26R introduces a control pressure commensurate with the amount of lever operation to a pilot port of the control valve 174, using hydraulic oil discharged by the pilot pump 15.

Specifically, when operated in a boom lowering direction, the right operating lever 26R introduces hydraulic oil to the right side pilot port of the control valve 175R. Furthermore, when operated in a boom raising direction, the right operating lever 26R introduces hydraulic oil to the right side pilot port of the control valve 175L and introduces hydraulic oil to the left side pilot port of the control valve 175R. When operated in a bucket closing direction, the right operating lever 26R introduces hydraulic oil to the right side pilot port of the control valve 174, and when operated in a bucket opening direction, the right operating lever 26R introduces hydraulic oil to the left side pilot port of the control valve 174.

The travel lever 26D is used to operate the crawlers 10. Specifically, the left travel lever 26DL is used to operate the left crawler 1CL. The left travel lever 26DL may be configured to operate together with a left travel pedal. When operated forward or backward, the left travel lever 26DL introduces a control pressure commensurate with the amount of lever operation to a pilot port of the control valve 171, using hydraulic oil discharged by the pilot pump 15. The right travel lever 26DR is used to operate the right crawler 1CR. The right travel lever 26DR may be configured to operate together with a right travel pedal. When operated forward or backward, the right travel lever 26DR introduces a control pressure commensurate with the amount of lever operation to a pilot port of the control valve 172, using hydraulic oil discharged by the pilot pump 15.

The discharge pressure sensor 28 includes a discharge pressure sensor 28L and a discharge pressure sensor 28R. The discharge pressure sensor 28L detects the discharge pressure of the left main pump 14L, and outputs the detected value to the controller 30. The same is the case with the discharge pressure sensor 28R.

The operating pressure sensor 29 includes operating pressure sensors 29LA, 29LB, 29RA, 29RB, 29DL and 29DR. The operating pressure sensor 29LA detects the details of the operator's forward or backward operation of the left operating lever 26L in the form of pressure, and outputs the detected value to the controller 30. Examples of the details of operation include the direction of lever operation and the amount of lever operation (the angle of lever operation).

Likewise, the operating pressure sensor 29LB detects the details of the operator's rightward or leftward operation of the left operating lever 26L in the form of pressure, and outputs the detected value to the controller 30. The operating pressure sensor 29RA detects the details of the operator's forward or backward operation of the right operating lever 26R in the form of pressure, and outputs the detected value to the controller 30. The operating pressure sensor 29RB detects the details of the operator's rightward or leftward operation of the right operating lever 26R in the form of pressure, and outputs the detected value to the controller 30. The operating pressure sensor 29DL detects the details of the operator's forward or backward operation of the left travel lever 26DL in the form of pressure, and outputs the detected value to the controller 30. The operating pressure sensor 29DR detects the details of the operator's forward or backward operation of the right travel lever 26DR in the form of pressure, and outputs the detected value to the controller 30.

The controller 30 receives the output of the operating pressure sensor 29, and outputs a control command to the regulator 13 to change the discharge quantity of the main pump 14 on an as-needed basis. Furthermore, the controller 30 receives the output of a control pressure sensor 19 provided upstream of a throttle 18, and outputs a control command to the regulator 13 to change the discharge quantity of the main pump 14 on an as-needed basis. The throttle 18 includes a left throttle 18L and a right throttle 18R, and the control pressure sensor 19 includes a left control pressure sensor 19L and a right control pressure sensor 19R.

In the left center bypass conduit 60L, the left throttle 18L is placed between the most downstream control valve 176L and the hydraulic oil tank. Therefore, the flow of hydraulic oil discharged by the left main pump 14L is restricted by the left throttle 18L. The left throttle 18L generates a control pressure for controlling the left regulator 13L. The left control pressure sensor 19L is a sensor for detecting this control pressure, and output a detected value to the controller 30. The controller 30 controls the discharge quantity of the left main pump 14L by adjusting the swash plate tilt angle of the left main pump 14L in accordance with this control pressure. The controller 30 decreases the discharge quantity of the left main pump 14L as this control pressure increases, and increases the discharge quantity of the left main pump 14L as this control pressure decreases. The discharge quantity of the right main pump 14R is controlled in the same manner.

Specifically, as illustrated in FIG. 14, in the standby state where none of the hydraulic actuators in the shovel PS is in operation, hydraulic oil discharged by the left main pump 14L passes through the left center bypass conduit 60L to reach the left throttle 18L. The flow of hydraulic oil discharged by the left main pump 14L increases the control pressure generated upstream of the left throttle 18L. As a result, the controller 30 decreases the discharge quantity of the left main pump 14L to a minimum allowable discharge quantity to control pressure loss (pumping loss) during passage of the discharged hydraulic oil through the left center bypass conduit 60L. When a hydraulic actuator is operated, hydraulic oil discharged by the left main pump 14L flows into the operated hydraulic actuator through a control valve corresponding to the operated hydraulic actuator. The flow of hydraulic oil discharged by the left main pump 14L that reaches the left throttle 18L is reduced in amount or lost, so that the control pressure generated upstream of the left throttle 18L is reduced. As a result, the controller 30 increases the discharge quantity of the left main pump 14L to circulate sufficient hydraulic oil to the operated hydraulic actuator to ensure driving of the operated hydraulic actuator. The controller 30 controls the discharge quantity of the right main pump 14R in the same manner.

According to the configuration as described above, the hydraulic system of FIG. 14 can reduce unnecessary energy consumption in the main pump 14L in the standby state. The unnecessary energy consumption includes pumping loss that hydraulic oil discharged by the main pump 14 causes in the center bypass conduit 60. Furthermore, in the case of actuating a hydraulic actuator, the hydraulic system of FIG. 14 can ensure that necessary and sufficient hydraulic oil is supplied from the main pump 14 to the hydraulic actuator to be actuated.

Next, a configuration for the controller 30 operating an actuator using the machine control function is described with reference to FIGS. 15A through 15D. FIGS. 15A through 15D are diagrams extracting part of the hydraulic system. Specifically, FIG. 15A is a diagram extracting part of the hydraulic system related to the operation of the arm cylinder 8. FIG. 15B is a diagram extracting part of the hydraulic system related to the operation of the boom cylinder 7. FIG. 15C is a diagram extracting part of the hydraulic system related to the operation of the bucket cylinder 9. FIG. 15D is a diagram extracting part of the hydraulic system related to the operation of the turning hydraulic motor 2A.

As illustrated in FIGS. 15A through 15D, the hydraulic system includes a proportional valve 31 and a shuttle valve 32. The proportional valve 31 includes proportional valves 31AL through 31DL and 31AR through 31DR. The shuttle valve 32 includes shuttle valves 32AL through 32DL and 32AR through 32DR.

The proportional valve 31 operates as a control valve for machine control. The proportional valve 31 is placed in a conduit connecting the pilot pump 15 and the shuttle valve 32, and is so configured as to be able to change the flow area of the conduit. According to the examples illustrated in FIGS. 15A through 15D, the proportional valve 31 operates in response to a control command output by the controller 30. Therefore, the controller 30 can supply hydraulic oil discharged by the pilot pump 15 to a pilot port of a corresponding control valve in the control valve 17 through the proportional valve 31 and the shuttle valve 32, independent of the operator's operation of the operating apparatus 26.

The shuttle valve 32 includes two inlet ports and one outlet port. Of the two inlet ports, one is connected to the operating apparatus and the other is connected to the proportional valve 31. The outlet port is connected to a pilot port of a corresponding control valve in the control valve 17.

Therefore, the shuttle valve 32 can cause the higher one of a pilot pressure generated by the operating apparatus 26 and a pilot pressure generated by the proportional valve 31 to act on a pilot port of a corresponding control valve.

According to this configuration, the controller 30 can operate a hydraulic actuator corresponding to a specific operating apparatus 26 even when no operation is performed on the specific operating apparatus 26.

For example, as illustrated in FIG. 15A, the left operating lever 26L is used to operate the arm 5. Specifically, the left operating lever 26L causes a pilot pressure commensurate with a forward or backward operation to act on a pilot port of the control valve 176, using hydraulic oil discharged by the pilot pump 15. More specifically, when operated in the arm closing direction (backward direction), the left operating lever 26L causes a pilot pressure commensurate with the amount of operation to act on the right side pilot port of the control valve 176L and the left side pilot port of the control valve 176R. Furthermore, when operated in the arm opening direction (forward direction), the left operating lever 26L causes a pilot pressure commensurate with the amount of operation to act on the left side pilot port of the control valve 176L and the right side pilot port of the control valve 176R.

The left operating lever 26L is provided with a switch NS. According to the example illustrated in FIG. 15A, the switch NS is a push button switch provided at the end of the left operating lever 26L. The operator can operate the left operating lever 26L while pressing the switch NS. The switch NS may be provided on the right operating lever 26R or at a different position in the cabin 10.

The operating pressure sensor 29LA detects the details of the operator's forward or backward operation of the left operating lever 26L in the form of pressure, and outputs the detected value to the controller 30.

The proportional valve 31AL operates in response to a current command output by the controller 30. The proportional valve 31AL controls a pilot pressure due to hydraulic oil introduced to the right side pilot port of the control valve 176L and the left side pilot port of the control valve 176R from the pilot pump 15 through the proportional valve 31AL and the shuttle valve 32AL. The proportional valve 31AR operates in response to a current command output by the controller 30. The proportional valve 31AR controls a pilot pressure due to hydraulic oil introduced to the left side pilot port of the control valve 176L and the right side pilot port of the control valve 176R from the pilot pump 15 through the proportional valve 31AR and the shuttle valve 32AR. The proportional valves 31AL and 31AR can control a pilot pressure such that the control valves 176L and 176R can stop at a desired valve position.

According to this configuration, the controller 30 can supply hydraulic oil discharged by the pilot pump 15 to the right side pilot port of the control valve 176L and the left side pilot port of the control valve 176R through the proportional valve 31AL and the shuttle valve 32AL, that is, can close the arm 5, independent of the operator's arm closing operation. Furthermore, the controller 30 can supply hydraulic oil discharged by the pilot pump 15 to the left side pilot port of the control valve 176L and the right side pilot port of the control valve 176R through the proportional valve 31AR and the shuttle valve 32AR, that is, can open the arm 5, independent of the operator's arm opening operation.

As illustrated in FIG. 15B, the right operating lever 26R is used to operate the boom 4. Specifically, the right operating lever 26R causes a pilot pressure commensurate with a forward or backward operation to act on a pilot port of the control valve 175, using hydraulic oil discharged by the pilot pump 15. More specifically, when operated in the boom raising direction (backward direction), the right operating lever 26R causes a pilot pressure commensurate with the amount of operation to act on the right side pilot port of the control valve 175L and the left side pilot port of the control valve 175R. Furthermore, when operated in the boom lowering direction (forward direction), the right operating lever 26R causes a pilot pressure commensurate with the amount of operation to act on the right side pilot port of the control valve 175R.

The operating pressure sensor 29RA detects the details of the operator's forward or backward operation of the right operating lever 26R in the form of pressure, and outputs the detected value to the controller 30.

The proportional valve 31BL operates in response to a current command output by the controller 30. The proportional valve 31BL controls a pilot pressure due to hydraulic oil introduced to the right side pilot port of the control valve 175L and the left side pilot port of the control valve 175R from the pilot pump 15 through the proportional valve 31BL and the shuttle valve 32BL. The proportional valve 31BR operates in response to a current command output by the controller 30. The proportional valve 31BR controls a pilot pressure due to hydraulic oil introduced to the right side pilot port of the control valve 175R from the pilot pump 15 through the proportional valve 31BR and the shuttle valve 32BR. The proportional valves 31BL and 31BR can control a pilot pressure such that the control valves 175L and 175R can stop at a desired valve position.

According to this configuration, the controller 30 can supply hydraulic oil discharged by the pilot pump 15 to the right side pilot port of the control valve 175L and the left side pilot port of the control valve 175R through the proportional valve 31BL and the shuttle valve 32BL, that is, can raise the boom 4, independent of the operator's boom raising operation. Furthermore, the controller 30 can supply hydraulic oil discharged by the pilot pump 15 to the right side pilot port of the control valve 175R through the proportional valve 31BR and the shuttle valve 32BR, that is, can lower the boom 4, independent of the operator's boom lowering operation.

Furthermore, as illustrated in FIG. 15C, the right operating lever 26R is also used to operate the bucket 6. Specifically, the right operating lever 26R causes a pilot pressure commensurate with a rightward or leftward operation to act on a pilot port of the control valve 174, using hydraulic oil discharged by the pilot pump 15. More specifically, when operated in the bucket closing direction (leftward direction), the right operating lever 26R causes a pilot pressure commensurate with the amount of operation to act on the left side pilot port of the control valve 174. Furthermore, when operated in the bucket opening direction (rightward direction), the right operating lever 26R causes a pilot pressure commensurate with the amount of operation to act on the right side pilot port of the control valve 174.

The operating pressure sensor 29RB detects the details of the operator's rightward or leftward operation of the right operating lever 26R in the form of pressure, and outputs the detected value to the controller 30.

The proportional valve 31CL operates in response to a current command output by the controller 30. The proportional valve 31CL controls a pilot pressure due to hydraulic oil introduced to the left side pilot port of the control valve 174 from the pilot pump 15 through the proportional valve 31CL and the shuttle valve 32CL. The proportional valve 31CR operates in response to a current command output by the controller 30. The proportional valve 31CR controls a pilot pressure due to hydraulic oil introduced to the right side pilot port of the control valve 174 from the pilot pump 15 through the proportional valve 31CR and the shuttle valve 32CR. The proportional valves 31CL and 31CR can control a pilot pressure such that the control valve 174 can stop at a desired valve position.

According to this configuration, the controller 30 can supply hydraulic oil discharged by the pilot pump 15 to the left side pilot port of the control valve 174 through the proportional valve 31CL and the shuttle valve 32CL, that is, can close the bucket 6, independent of the operator's bucket closing operation. Furthermore, the controller 30 can supply hydraulic oil discharged by the pilot pump 15 to the right side pilot port of the control valve 174 through the proportional valve 31CR and the shuttle valve 32CR, that is, can open the bucket 6, independent of the operator's bucket opening operation.

Furthermore, as illustrated in FIG. 15D, the left operating lever 26L is also used to operate the turning mechanism 2. Specifically, the left operating lever 26L causes a pilot pressure commensurate with a rightward or leftward operation to act on a pilot port of the control valve 173, using hydraulic oil discharged by the pilot pump 15. More specifically, when operated in the left turning direction (leftward direction), the left operating lever 26L causes a pilot pressure commensurate with the amount of operation to act on the left side pilot port of the control valve 173. Furthermore, when operated in the right turning direction (rightward direction), the left operating lever 26L causes a pilot pressure commensurate with the amount of operation to act on the right side pilot port of the control valve 173.

The operating pressure sensor 29LB detects the details of the operator's rightward or leftward operation of the left operating lever 26L in the form of pressure, and outputs the detected value to the controller 30.

The proportional valve 31DL operates in response to a current command output by the controller 30. The proportional valve 31DL controls a pilot pressure due to hydraulic oil introduced to the left side pilot port of the control valve 173 from the pilot pump 15 through the proportional valve 31DL and the shuttle valve 32DL. The proportional valve 31DR operates in response to a current command output by the controller 30. The proportional valve 31DR controls a pilot pressure due to hydraulic oil introduced to the right side pilot port of the control valve 173 from the pilot pump 15 through the proportional valve 31DR and the shuttle valve 32DR. The proportional valves 31DL and 31DR can control a pilot pressure such that the control valve 173 can stop at a desired valve position.

According to this configuration, the controller 30 can supply hydraulic oil discharged by the pilot pump 15 to the left side pilot port of the control valve 173 through the proportional valve 31DL and the shuttle valve 32DL, that is, can turn the turning mechanism 2 counterclockwise, independent of the operator's left turning operation. Furthermore, the controller 30 can supply hydraulic oil discharged by the pilot pump 15 to the right side pilot port of the control valve 173 through the proportional valve 31DR and the shuttle valve 32DR, that is, can turn the turning mechanism 2 clockwise, independent of the operator's right turning operation.

The shovel PS may include a configuration to cause the lower traveling body 1 to automatically travel forward and backward. In this case, part of the hydraulic system related to the operation of the left travel hydraulic motor 2ML and part of the hydraulic system related to the operation of the right travel hydraulic motor 2MR are configured the same as part of the hydraulic system related to the operation of the boom cylinder 7, etc.

Furthermore, while a hydraulic operating lever including a hydraulic pilot circuit is described above as a type of the operating apparatus 26, an electrical operating lever including an electrical pilot circuit may be employed instead of a hydraulic operating lever. In this case, the amount of lever operation of the electrical operating lever is input to the controller 30 as an electrical signal. Furthermore, a solenoid valve is placed between the pilot pump 15 and a pilot port of each control valve. The solenoid valve is configured to operate in response to an electrical signal from the controller 30. According to this configuration, when a manual operation using the electrical operating lever is performed, the controller 30 can move each control valve by increasing or decreasing a pilot pressure by controlling the solenoid valve using an electrical signal commensurate with the amount of lever operation. Each solenoid valve may be constituted of a solenoid spool valve. In this case, the solenoid spool valve operates in response to an electrical signal from the controller 30 commensurate with the amount of lever operation of the electrical operating lever.

Next, functions of the controller 30 are described with reference to FIG. 16. FIG. 16 is a functional block diagram of the controller 30. According to the example of FIG. 16, the controller 30 is so configured as to be able to receive the output signal of at least one of the posture detector, the operating apparatus 26, the space recognition device 70, the orientation detector 71, the information input device 72, the positioning device P1, the switch NS, etc., execute various computations, and output a control signal to at least one of the proportional valve 31, the display device 40, the audio output device 43, etc. The posture detector includes the boom angle sensor S1, the arm angle sensor S2, the bucket angle sensor S3, the body tilt sensor S4, and the turning angular velocity sensor S5. The controller 30 includes a position calculating part 30A, a trajectory obtaining part 30B, and an autonomous control part 30C as functional elements. The functional elements may be either constituted of hardware or constituted of software.

The position calculating part 30A is configured to calculate the position of an object whose location is to be determined. According to the example illustrated in FIG. 16, the position calculating part 30A calculates the coordinate point of a predetermined part of the attachment in a reference coordinate system. The predetermined part is, for example, the teeth tips of the bucket 6. The origin of the reference coordinate system is, for example, the point of intersection of the turning axis and the ground contact surface of the shovel PS. The position calculating part 30A, for example, calculates the coordinate point of the teeth tips of the bucket 6 from the respective rotation angles of the boom 4, the arm 5, and the bucket 6. The position calculating part 30A may calculate not only the coordinate point of the center of the teeth tips of the bucket 6 but also the coordinate point of the left end of the teeth tips of the bucket 6 and the coordinate point of the right end of the teeth tips of the bucket 6. In this case, the position calculating part 30A may use the output of the body tilt sensor S4.

The trajectory obtaining part 30B is configured to obtain a target trajectory that is a trajectory that a predetermined part of the attachment follows when the shovel PS is caused to autonomously operate. According to the example illustrated in FIG. 16, the trajectory obtaining part 30B obtains the target trajectory which the autonomous control part 30C uses when causing the shovel PS to autonomously operate.

Specifically, the trajectory obtaining part 30B derives the target trajectory based on data on a target work surface stored in a nonvolatile storage device. The trajectory obtaining part 30B may alternatively derive the target trajectory based on information on a ground form around the shovel PS recognized by the space recognition device 70. The trajectory obtaining part 30B may alternatively derive information on the past trajectories of the teeth tips of the bucket 6 from the past output of the posture detector stored in a nonvolatile storage device and derive the target trajectory based on the information. The trajectory obtaining part 30B may alternatively derive the target trajectory based on the current position of a predetermined part of the attachment and data on a target work surface.

The autonomous control part 30C is configured to cause the shovel PS to autonomously operate. According to the example illustrated in FIG. 16, the autonomous control part 30C is configured to move a predetermined part of the attachment along the target trajectory obtained by the trajectory obtaining part 30B when a predetermined start condition is satisfied. Specifically, when the operating apparatus 26 is operated with the switch NS being pressed, the autonomous control part 30C causes the shovel PS to autonomously operate such that the predetermined part moves along the target trajectory.

According to the example illustrated in FIG. 16, the autonomous control part 30C is configured to assist the operator in manually operating the shovel by causing actuators to autonomously operate. For example, when the operator is manually performing an arm closing operation while pressing the switch NS, the autonomous control part 30C may cause at least one of the boom cylinder 7, the arm cylinder 8, and the bucket cylinder 9 to autonomously extend or retract such that the position of the teeth tips of the bucket 6 matches the target trajectory. In this case, for example, the operator can close the arm 5 while matching the teeth tips of the bucket 6 with the target trajectory by operating the left operating lever 26L in the arm closing direction alone. According to this example, the arm cylinder 8 that is a primary target of operation is referred to as "primary actuator." Furthermore, the boom cylinder 7 and the bucket cylinder 9, which are secondary targets of operation that move in accordance with the movement of the primary actuator, are referred to as "secondary actuators".

According to the example illustrated in FIG. 16, the autonomous control part 30C can cause each actuator to autonomously operate by providing the proportional valve 31 with a current command to individually control a pilot pressure acting on a control valve corresponding to each actuator. For example, independent of whether the right operating lever 26R is tilted or not, the autonomous control part 30C can cause at least one of the boom cylinder 7 and the bucket cylinder 9 to operate.

What is claimed is:

1. A shovel comprising:

a lower traveling body;

an upper turning body turnably attached to the lower traveling body;

an attachment including a boom, an arm, and an end attachment, the attachment being attached to the upper turning body;

a boom state detector configured to detect a state of the boom;

an arm state detector configured to detect a state of the arm;

an end attachment state detector configured to detect a state of the end attachment; and a hardware processor configured to obtain information on a position of the end attachment based on respective outputs of the boom state detector, the arm state detector, and the end attachment state detector, correlate the information on the position of the end attachment with information on a position of an underground object obtained based on an output of an underground object detector and calculate a distance between the end attachment and the underground object, and control the shovel such that the distance is prevented from falling below a predetermined value.

2. The shovel as claimed in claim 1, wherein the underground object detector is mounted on the shovel and is configured to output the information on the position of the underground object to the control device.

3. The shovel as claimed in claim 1, wherein the hardware processor is configured to display an image of the underground object.

4. The shovel as claimed in claim 1, further comprising:

a storage device, wherein the underground object includes a buried object, information on a position of the buried object is stored in the storage device, and the hardware processor is configured to correct the information on the position of the buried object based on the output of the underground object detector.

5. The shovel as claimed in claim 4, wherein the hardware processor is configured to display an image of the buried object such that a difference between the information on the position of the buried object stored in the storage device and information on a position of the buried object detected by the underground object detector is recognizable.

6. The shovel as claimed in claim 1, further comprising:

a display device configured to display a screen graphically representing a relative relationship between the end attachment and the underground object, wherein a graphic shape configured to move in accordance with a movement of the end attachment is displayed within the screen.

7. The shovel as claimed in claim 1, further comprising:

an audio output device configured to output an audio such that the output audio changes in accordance with a relative relationship between the end attachment and the underground object.

8. The shovel as claimed in claim 1, wherein the hardware processor is configured to correct information on a position of a buried object based on information on a position of a burial indicator sheet.

9. A system of managing a shovel, the shovel including a lower traveling body; an upper turning body turnably attached to the lower traveling body; an attachment including a boom, an arm, and an end attachment, the attachment being attached to the upper turning body; a boom state detector configured to detect a state of the boom; an arm state detector configured to detect a state of the arm; an end attachment state detector configured to detect a state of the end attachment; and a shovel hardware processor, the system comprising:

a management apparatus including an apparatus hardware processor, the apparatus hardware processor being configured to obtain information on a position of the end attachment based on respective outputs of the boom state detector, the arm state detector, and the end attachment state detector, and correlate the information on the position of the end attachment with information on a position of an underground object obtained based on an output of an underground object detector and calculate a distance between the end attachment and the underground object, and wherein the shovel hardware processor is configured to control the shovel such that the distance is prevented from falling below a predetermined value.

10. The system as claimed in claim 9, wherein the management apparatus includes a storage part, the underground object includes a buried object, information on a position of the buried object is stored in the storage device, and the apparatus hardware processor is configured to correct the information on the position of the buried object based on the output of the underground object detector.

* * * * *